US008894396B2

(12) United States Patent
Misunou et al.

(10) Patent No.: US 8,894,396 B2
(45) Date of Patent: Nov. 25, 2014

(54) PUMP APPARATUS WITH PRESSING MEANS

(75) Inventors: Masaki Misunou, Atsugi (JP); Toshihiro Koizumi, Atsugi (JP); Chiharu Nakazawa, Kawasaki (JP)

(73) Assignee: Hitachi Automotive Systems, Ltd., Hitachinaka-shi (JP)

( * ) Notice: Subject to any disclaimer, the term of this patent is extended or adjusted under 35 U.S.C. 154(b) by 842 days.

(21) Appl. No.: 13/080,714

(22) Filed: Apr. 6, 2011

(65) Prior Publication Data

US 2012/0051961 A1 Mar. 1, 2012

(30) Foreign Application Priority Data

Aug. 27, 2010 (JP) ..... 2010-191010

(51) Int. Cl.
*F04C 2/10* (2006.01)
*F04C 2/14* (2006.01)
*F04C 15/00* (2006.01)

(52) U.S. Cl.
CPC ..... *F04C 2/10* (2013.01); *F04C 15/0026* (2013.01); *F04C 2230/602* (2013.01); *F04C 2/14* (2013.01)
USPC ..... 418/206.6; 418/206.7; 418/206.9

(58) Field of Classification Search
CPC .. F04C 15/0026; F04C 2230/602; F04C 2/10; F04C 2/14
USPC ..... 418/206.6, 206.7, 206.9
See application file for complete search history.

(56) References Cited

U.S. PATENT DOCUMENTS

| | | | | |
|---|---|---|---|---|
| 4,298,319 | A * | 11/1981 | Glidden | 418/132 |
| 8,684,473 | B2 * | 4/2014 | Nakazawa et al. | 418/206.6 |
| 2010/0196186 | A1 * | 8/2010 | Helbing et al. | 418/206.6 |
| 2010/0215538 | A1 * | 8/2010 | Kinsler | 418/206.6 |

FOREIGN PATENT DOCUMENTS

JP 63-277878 A 11/1988

* cited by examiner

*Primary Examiner* — Mary A Davis
(74) *Attorney, Agent, or Firm* — Crowell & Moring LLP

(57) ABSTRACT

A pump apparatus including a drive shaft and a driven shaft supported by bearing members, respectively, a center plate, first external gears, second external gears, first and second side plates, first and second seal members, a pressing means for applying a pressing force between the tooth tips of the respective external gears and the seal surface of the respective seal members in a closing region disposed between the respective external gears and the respective seal members, wherein contact between inner circumferential surfaces of the bearing members and an outer circumferential surface of the drive shaft is established on the side of the closing region, while the tooth tips of the respective external gears and the seal surface of the respective seal members in the closing region are kept pressed against each other by the pressing means.

18 Claims, 19 Drawing Sheets

PUMP APPARATUS WITH PRESSING MEANS

BACKGROUND OF THE INVENTION

The present invention relates to a pump apparatus.

Japanese Patent Application Unexamined Publication No. 63-277878 discloses a pump apparatus including a gear shaft with a drive gear and a gear shaft with a driven gear meshing with the drive gear. These gear shafts are supported in bearing holes which are formed in a pump body and a cover, respectively.

SUMMARY OF THE INVENTION

In order to perform positioning of the gear shafts with high accuracy in such a pump apparatus of the above conventional art, dimensional accuracy of parts must be enhanced and positioning of the pump body, the cover and a side plate relative to each other must be carried out using locating pins or the like. However, if the dimensional accuracy of parts is excessively enhanced, an assembling efficiency will be lowered. On the other hand, if the dimensional accuracy of parts is reduced in consideration of the assembling efficiency, there will occur a clearance between the respective gear shafts and the respective bearing holes. Due to occurrence of the clearance, the gear shafts and gears supported on the gear shafts undergo undesirable displacement, and a leakage of working oil through the clearance is caused to thereby reduce a pump efficiency.

It is an object of the present invention to solve the above-described problem in the pump apparatus of the conventional art and to provide a pump apparatus capable of ensuring high accuracy in positioning of gear shafts and improving assembling efficiency thereof.

The other objects and features of this invention will become understood from the following description with reference to the accompanying drawings.

In a first aspect of the present invention, there is provided a pump apparatus including:

- a drive shaft supported by drive-side bearing members on both end portions of the drive shaft;
- a driven shaft supported by driven-side bearing members on both end portions of the driven shaft;
- first external gears including a first drive gear which is driven by the drive shaft and a first driven gear which is meshed with the first drive gear and supported on the driven shaft;
- a center plate formed with a first through-hole through which the drive shaft extends and a second through-hole through which the driven shaft extends;
- second external gears which are opposed to the first external gears so as to sandwich the center plate between the first and second external gears, the second external gears including a second drive gear which is driven by the drive shaft and a second driven gear which is meshed with the second drive gear and supported on the driven shaft;
- a first side plate which is disposed to sandwich the first external gears between the first side plate and the center plate;
- a second side plate which is disposed to sandwich the second external gears between the second side plate and the center plate;
- a first seal member which includes seal surfaces sealing tooth tips of the first external gears and defines a first pump chamber in cooperation with the center plate;

- a second seal member which includes seal surfaces sealing tooth tips of the second external gears and defines a second pump chamber in cooperation with the center plate; and
- a pressing means for applying a pressing force between the tooth tips of the respective first and second external gears and the seal surfaces of the respective first and second seal members in a closing region disposed between the respective first and second external gears and the respective first and second seal members such that the tooth tips of the respective first and second external gears and the seal surfaces of the respective first and second seal members are allowed to press against each other in the closing region,
- wherein contact between an inner circumferential surface of the respective drive-side bearing members and an outer circumferential surface of the drive shaft and contact between an inner circumferential surface of the respective driven-side bearing members and an outer circumferential surface of the driven shaft are established on the side of the closing region, while the tooth tips of the respective first and second external gears and the seal surfaces of the respective first and second seal members in the closing region are kept pressed against each other by the pressing means.

In a second aspect of the present invention, there is provided the pump apparatus according to the first aspect, wherein assuming that the closing region disposed between the first and second external gears and the first and second seal members is located in a first quadrant of a unit circle in a coordinate plane which has a center aligned with a central axis of the first through-hole of the center plate, the side of the closing region in which the contact between the inner circumferential surface of the respective drive-side bearing members and the outer circumferential surface of the drive shaft is established and the side of the closing region in which the contact between the inner circumferential surface of the respective driven-side bearing members and the outer circumferential surface of the driven shaft is established are located in the first quadrant and/or a second quadrant of the unit circle.

In a third aspect of the present invention, there is provided the pump apparatus according to the second aspect, wherein the center plate is formed with a first pressing means accommodating hole and a second pressing means accommodating hole, and the pressing means are shaft seal members which are disposed between an inner circumferential surface of the first pressing means accommodating hole and the outer circumferential surface of the drive shaft and between an inner circumferential surface of the second pressing means accommodating hole and the outer circumferential surface of the driven shaft, respectively, the shaft seal members serving for blocking fluid communication between the first pump chamber and the second pump chamber.

In a fourth aspect of the present invention, there is provided the pump apparatus according to the third aspect, further including:

- a housing having drive-side bearing mounting holes into which the drive-side bearing members are mounted, respectively, and driven-side bearing mounting holes into which the driven-side bearing members are mounted, respectively; and
- a clearance reducing means for establishing the contact between the inner circumferential surface of the respective drive-side bearing members and the outer circumferential surface of the drive shaft and the contact between the inner circumferential surface of the respective driven-side bearing members and the outer circumferential surface of the driven shaft on the side of the closing region, the clearance reducing means being disposed between the respective drive-side bearing mounting holes and the drive shaft and between the respective driven-side bearing mounting holes and the driven shaft.

In a fifth aspect of the present invention, there is provided the pump apparatus according to the fourth aspect, wherein the first seal member and the first side plate are integrally formed with each other and held in place relative to the center plate in such a state that the tooth tips of the first external gears are kept in contact with the seal surfaces of the first seal member.

DETAILED DESCRIPTION OF THE INVENTION

A pump apparatus according to a first embodiment of the present invention will be explained hereinafter with reference to the accompanying drawings.

[General Construction]

Figure 1B:
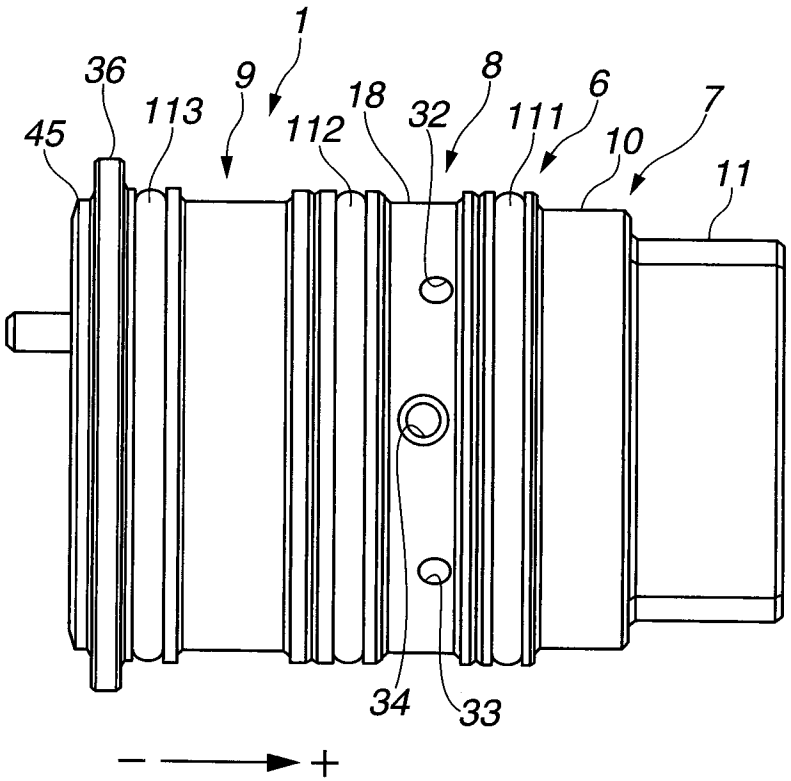
FIG. 1A and FIG. 1B are external views of a pump apparatus according to a first embodiment of the present invention.
Figure 1A:
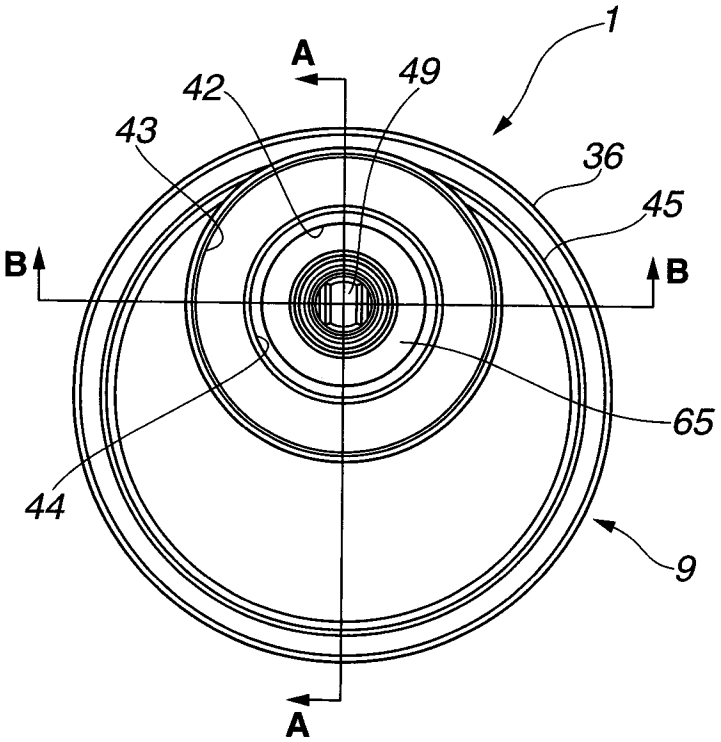
Figure 2:
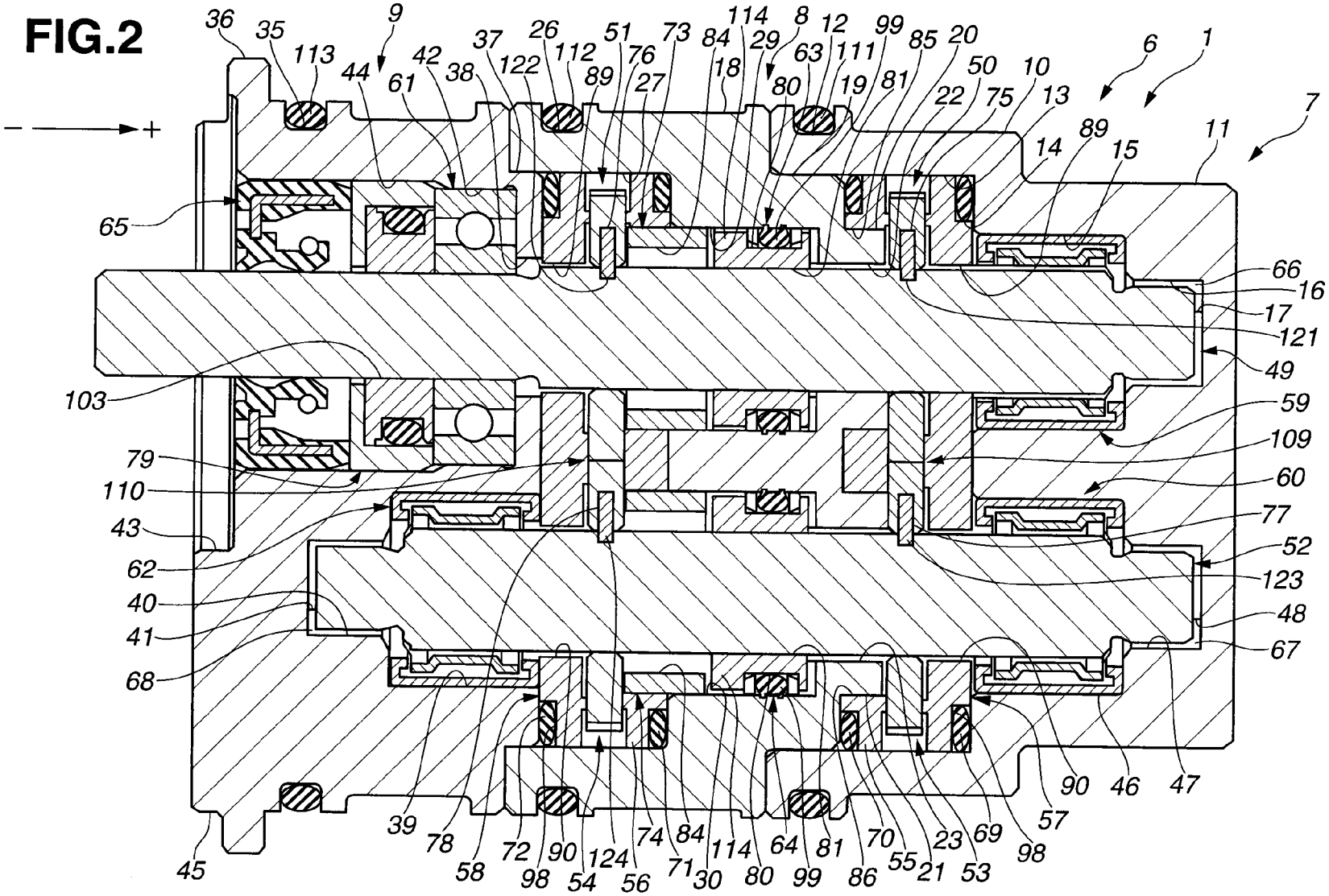
FIG. 2 is a cross section, taken along line A-A shown in FIG. 1A, of the pump apparatus according to the first embodiment of the present invention.
Figure 3:
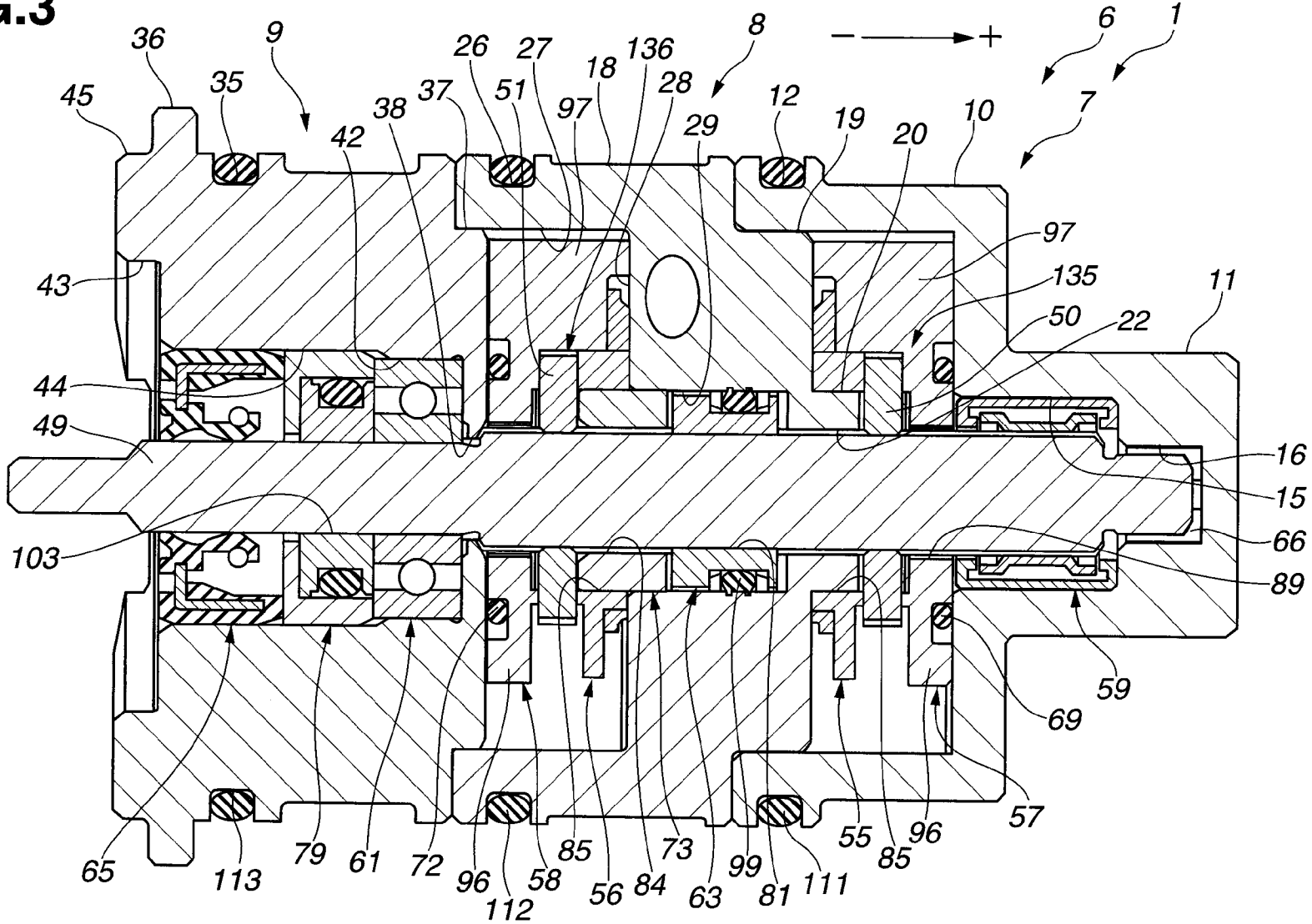
FIG. 3 is a cross section, taken along line B-B shown in FIG. 1A, of the pump apparatus according to the first embodiment of the present invention.
Figure 4:
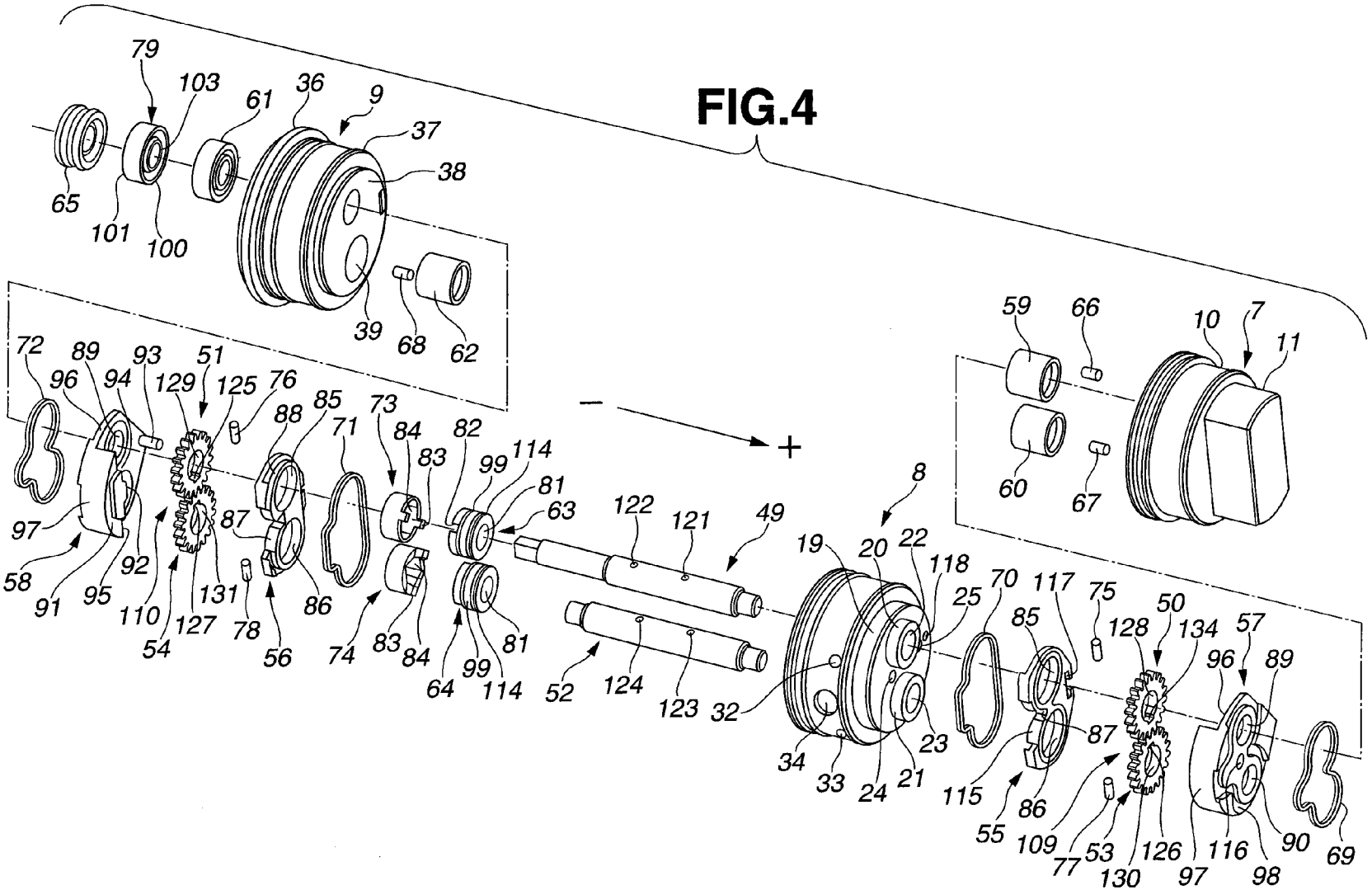
FIG. 4 is an exploded perspective view of the pump apparatus according to the first embodiment of the present invention.

FIG. 1A is an external view of pump apparatus 1 according to a first embodiment of the present invention when viewed from an axial outside of pump apparatus 1. FIG. 1B is an external view of pump apparatus 1 when viewed from a radial outside of pump apparatus 1. FIG. 2 is a cross section of pump apparatus 1, taken along line A-A of FIG. 1A. FIG. 3 is a cross section of pump apparatus 1, taken along line B-B of FIG. 1A. FIG. 4 is an exploded perspective view of pump apparatus 1. Pump apparatus 1 may be a pump apparatus for a brake apparatus for increasing fluid pressures in a plurality of wheel cylinders of a vehicle. In this embodiment, pump apparatus 1 is a tandem external gear pump in which fluid pressures in a plurality of wheel cylinders are increased by pumping action of first pump chamber 135 and second pump chamber 136 as described later. Pump apparatus 1 is driven by a motor (not shown) and accommodated in a housing (not shown) having a brake fluid circuit together with the motor to thereby constitute a fluid pressure unit as a whole.

As seen from FIGS. 1A and 1B, pump apparatus 1 includes pump casing 6 having a generally cylindrical shape. Pump casing 6 is constituted of front casing 7, center plate 8 and rear casing 9. An end portion of pump apparatus 1 which is located on the side of rear casing 9 is mounted to the housing. For the purpose of simple illustration, in an assembled state of pump apparatus 1, the side of front casing 7 and the side of rear casing 9 are hereinafter referred to as an axial-positive side and an axial-negative side in an axial direction of pump apparatus 1 as indicated by (+), (−) in FIGS. 1A and 1B, respectively.

As shown in FIG. 2 to FIG. 4, pump casing 6 accommodates drive shaft 49 which is rotatably driven by the motor, first drive gear 50 and second drive gear 51 which are driven by drive shaft 49, first driven gear 53 and second driven gear 54 which are meshed with first drive gear 50 and second drive gear 51, respectively, and supported on driven shaft 52. Pump casing 6 further accommodates first side plate 55 abutting on an axial negative side surface of first external gears 109 which are constituted of first drive gear 50 and first driven 53, first seal block 57 which abuts on an axial-positive side surface of first external gears 109 and seals meshing portion of first external gears 109, second side plate 56 abutting on an axial-positive side surface of second external gears 110 which are constituted of second drive gear 51 and second driven gear 54, and second seal block 58 which abuts on an axial-negative side surface of second external gears 110 and seals meshing portion of second external gears 110. Pump casing 6 further accommodates drive side needle bearing 59 and drive side ball bearing 61 which support opposite end portions of drive shaft 49, first driven side needle bearing 60 and second driven side needle bearing 62 which support opposite end portions of driven shaft 52, drive side shaft seal member 63 and driven side shaft seal member 64 which clamp center plate 8 and prevent communication of a working oil between the side of first external gears 109 and the side of second external gears 110, and pressure reducing seal member 79 and drive side seal member 65 which prevent the working oil from leaking out of rear casing 9 to an outside thereof.

[Construction of Front Casing]

Figure 5C:
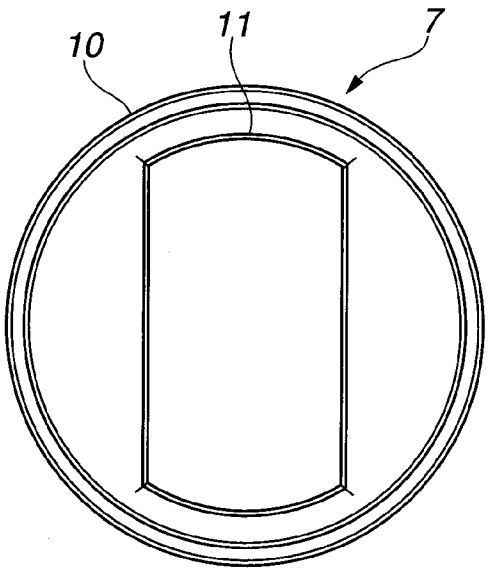
FIG. 5A to FIG. 5C are external views of a front casing of the pump apparatus according to the first embodiment of the present invention.
Figure 5B:
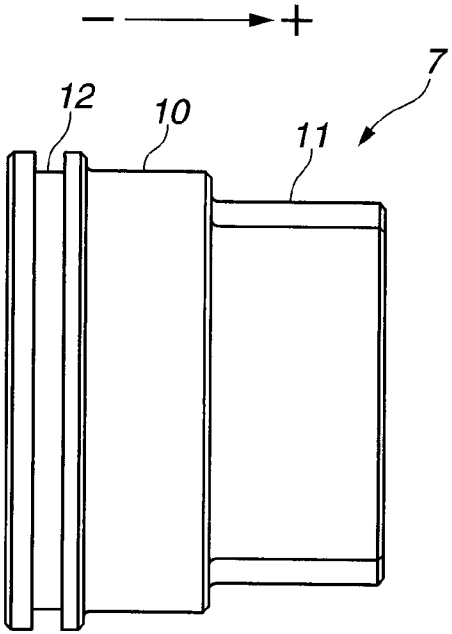
Figure 5A:
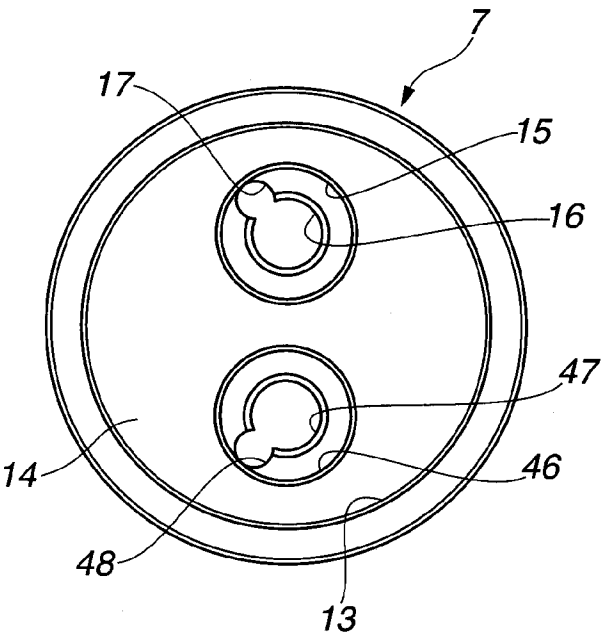

FIG. 5A is an external view of front casing 7 when viewed from the axial-negative side. FIG. 5B is an external view of front casing 7 when viewed from a radial outside thereof. FIG. 5C is an external view of front casing 7 when viewed from the axial-positive side.

As shown in FIG. 1A to FIG. 5C, front casing 7 includes cylindrical portion 10 and shaft accommodating portion 11 which extends from an axial positive end portion of cylindrical portion 10. Shaft accommodating portion 11 has an elongated shape extending in a radial direction of front casing 7. Cylindrical portion 10 is provided along an outer circumferential surface thereof with seal groove 12 having a generally U-shape in section. O-ring 111 is disposed in seal groove 12 as best shown in FIG. 3.

Cylindrical portion 10 includes a generally cup-shaped hollow portion opened to the axial-negative side. The cup-shaped hollow portion includes a circumferential side wall which defines gear accommodating hole 13, and a bottom wall which defines bottom portion 14. Disposed in gear accommodating hole 13 is first external gears 109.

Bearing mounting holes 15, 46 extend from bottom portion 14 into shaft accommodating portion 11, and are arranged in parallel with each other in a longitudinal direction of shaft accommodating portion 11. Drive side needle bearing 59 is press-fitted into bearing mounting hole 15. First driven side needle bearing 60 is press-fitted into bearing mounting hole 46.

Drive shaft accommodating hole 16 and driven shaft accommodating hole 47 are disposed adjacent to bearing mounting hole 15 on the axial-positive side to open to bearing mounting hole 15. Axial positive end portions of drive shaft 49 and driven shaft are disposed in drive shaft accommodating hole 16 and driven shaft accommodating hole 47, respectively. Eccentric pin accommodating hole 17 is disposed adjacent to drive shaft accommodating hole 16 in parallel therewith. Eccentric pin accommodating hole 48 is disposed adjacent to drive shaft accommodating hole 47 in parallel therewith. A portion of eccentric pin accommodating hole 17 is merged with drive shaft accommodating hole 16. A portion of eccentric pin accommodating hole 48 is merged with driven shaft accommodating hole 47.

Disposed in eccentric pin accommodating hole 17 is drive side pressing pin 66. A portion of a circumferential side surface of pressing pin 66 is exposed to drive shaft accommodating hole 16. Disposed in eccentric pin accommodating hole 48 is first driven side pressing pin 67. A portion of a circumferential side surface of pressing pin 67 is exposed to driven shaft accommodating hole 47. Eccentric pin accommodating hole 17 and eccentric pin accommodating hole 48 are arranged in a symmetrical relation to each other with respect to a closing (or confining) region (hereinafter referred to as a closing region) disposed between gears 50, 53, 51, 54 and seal block portions 97 of first and second seal blocks 57, 58, respectively, along axes of drive shaft accommodating hole 16 and driven shaft accommodating hole 47.

With this arrangement, eccentric pin 66 allows the axial-positive side end portion of drive shaft 49 to be pressed toward the side of the closing region such that a portion of drive shaft 49 on the side of the closing region and rollers of drive side needle bearing 59 are contacted with each other. Eccentric pin 67 allows the axial-positive side end portion of driven shaft 52 to be pressed toward the side of the closing region such that a portion of driven shaft 52 on the side of the closing region and rollers of first driven side needle bearing 60 are contacted with each other. This function will be explained in detail later.

[Construction of Center Plate]

Figure 6C:
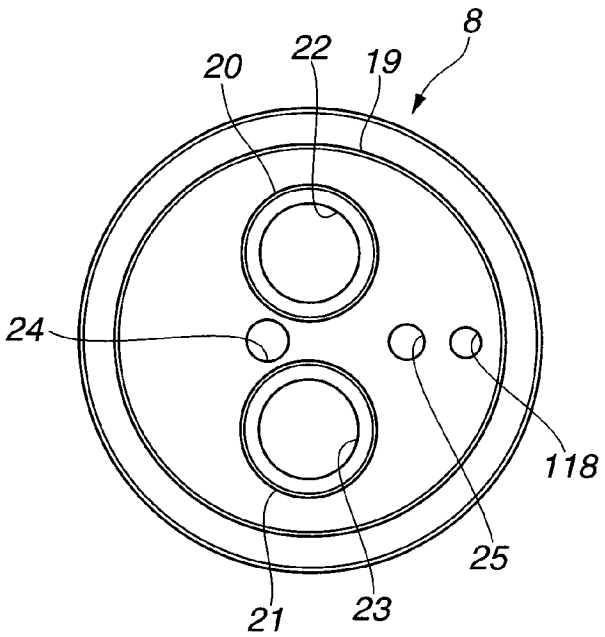
FIG. 6A to FIG. 6C are external views of a center plate of the pump apparatus according to the first embodiment of the present invention.
Figure 6B:
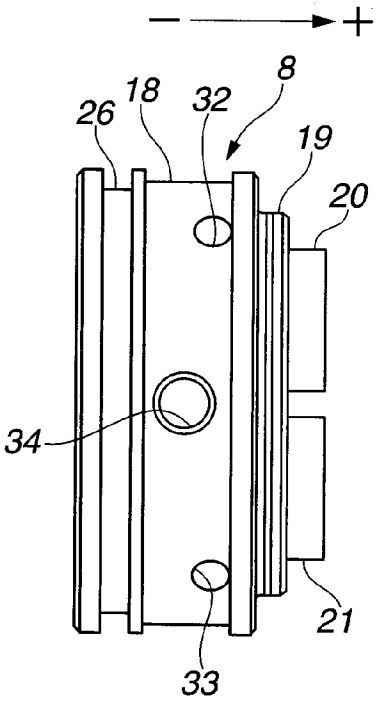
Figure 6A:
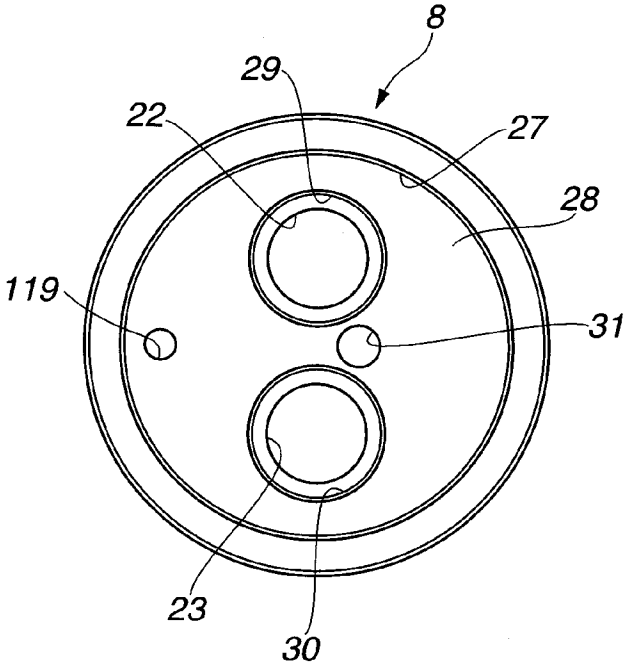

FIG. 6A is an external view of center plate 8 when viewed from the axial-negative side. FIG. 6B is an external view of center plate 8 when viewed from a radial outside thereof. FIG. 6C is an external view of center plate 8 when viewed from the axial-positive side.

As seen from FIG. 1A to FIG. 4 and FIG. 6A to FIG. 6C, center plate 8 as a whole has a generally cylindrical shape and has an axial length smaller than a diameter thereof. Center plate 8 has suction/discharge groove 18 having a generally U-shaped section and seal groove 26 on an outer circumferential surface thereof. Seal groove 26 is disposed on the axial-negative side of suction/discharge groove 18, into which O-ring 112 is mounted. Center plate 8 has front casing fitting projection 19 on the axial-positive side which extends toward the axial-positive side. Front casing fitting projection 19 has a diameter slightly smaller than that of gear accommodating hole 13 of front casing 7 and is fitted into gear accommodating hole 13. Center plate 8 and front casing 7 are fixed to each other by welding.

Disposed on an axial-positive side end surface of front casing fitting projection 19 are side plate fitting projections 20, 21 which extend toward the axial-positive side of front casing fitting projection 19. Side plate fitting projections 20, 21 are arranged along a straight line extending in a direction of a diameter of center plate 8. Side plate fitting projections 20, 21 are fitted into drive side fitting hole 85 and driven side fitting hole 86 of side plate 55, respectively. Side plate fitting projections 20, 21 are formed with drive shaft through-hole 22 and driven shaft through-hole 23 which extend through center plate 8 in an axial direction of center plate 8.

Further, disposed on the axial-positive side end surface of front casing fitting projection 19 are suction downstream opening 24, discharge upstream opening 25 and seal block engaging hole 118. Suction downstream opening 24 is communicated with suction upstream opening 32 opened to a bottom of suction/discharge groove 18 via a fluid passage which is formed in center plate 8. Discharge upstream opening 25 is communicated with discharge downstream opening 33 opened to the bottom of suction/discharge groove 18 via a fluid passage which is formed in center plate 8. Seal block engaging hole 118 is engaged with engaging projection 93 of first seal block 57. The engagement of seal block engaging hole 118 with engaging projection 93 is explained in detail later.

Center plate 8 is formed into a hollow cup shape opened to the axial-negative side. Center plate 8 includes gear accommodating hole 27 defined by a circumferential side wall, and bottom portion 28 defined by a bottom wall. Second external gears 110, etc., are disposed in gear accommodating hole 27.

Bottom portion 28 is formed with shaft seal member accommodating holes 29, 30 which are communicated with drive shaft through-hole 22 and driven shaft through-hole 23 and disposed coaxially with drive shaft through-hole 22 and driven shaft through-hole 23, respectively. Drive-side shaft seal member 63 and drive-side side plate fitting member 73 are disposed in shaft seal member accommodating hole 29. Driven-side shaft seal member 64 and driven-side side plate fitting member 74 are disposed in shaft seal member accommodating hole 30.

Further, bottom portion 28 is formed with suction downstream opening 31 and seal block engaging hole 119. Suction downstream opening 31 is communicated with suction upstream opening 32 opened to the bottom of suction discharge groove 18 via a fluid passage formed in center plate 8. Seal block engaging hole 119 is engaged with engaging projection 93 of second seal block 58. The engagement of seal block engaging hole 119 with engaging projection 93 is explained in detail later.

Also, formed in the bottom of suction discharge groove 18 is discharge downstream opening 34 which extends through the circumferential side wall of center plate 8 and is communicated with gear accommodating hole 27.

[Construction of Rear Casing]

Figure 7C:
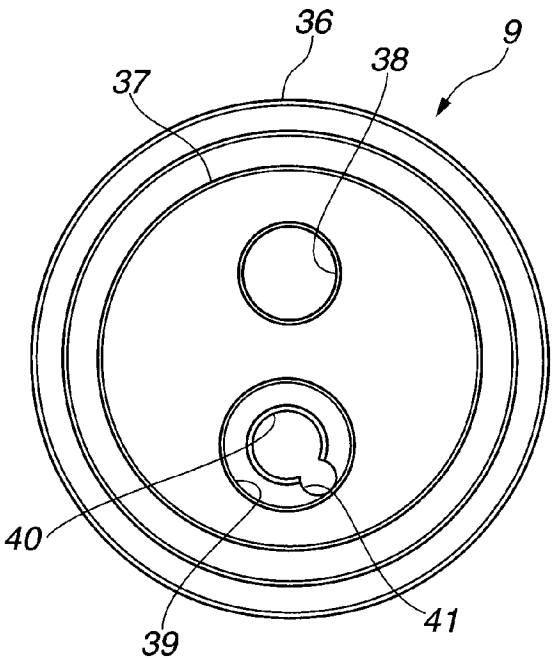
FIG. 7A to FIG. 7C are external views of a rear casing of the pump apparatus according to the first embodiment of the present invention.
Figure 7B:
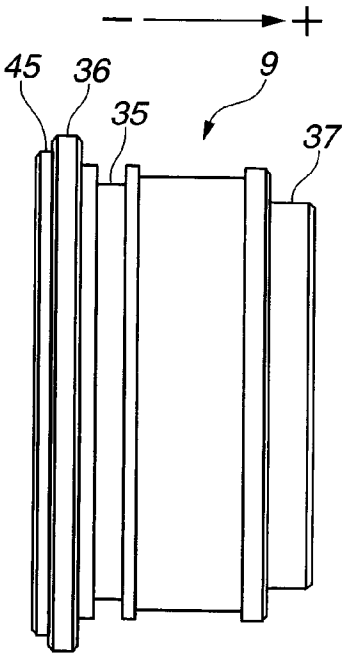
Figure 7A:
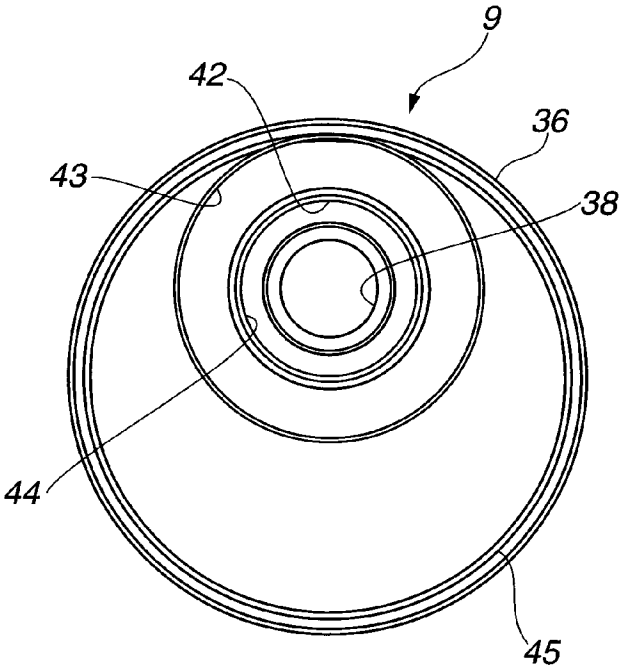

FIG. 7A is an external view of rear casing 9 when viewed from the axial-negative side. FIG. 7B is an external view of rear casing 9 when viewed from a radial outside thereof. FIG. 7C is an external view of rear casing 9 when viewed from the axial-positive side.

As seen from FIG. 1A to FIG. 4 and FIG. 7A to FIG. 7C, rear casing 9 as a whole has a generally cylindrical shape in external view and has an axial length thereof smaller than a diameter thereof. Rear casing 9 has seal groove 35 and flange 36 on an outer circumferential surface thereof. Seal groove 35 is provided in the form of a recessed groove and extends over an entire circumference of rear casing 9. Flange 36 is disposed on the axial-negative side of seal groove 35 and extends over the entire circumference of rear casing 9. O-ring 113 is fitted into seal groove 35. Pump apparatus 1 is inserted into a through-hole formed in the housing from the axial-positive side. Flange 36 has a diameter larger than the through-hole of the housing, whereby positioning of pump apparatus 1 relative to the housing is carried out by abutment of flange 36 onto the housing.

Disposed on the axial-positive side of rear casing 9 is center plate fitting projection 37 which extends toward the axial-positive side of rear casing 9. Center plate fitting projection 37 has a diameter slightly smaller than that of gear accommodating hole 27 of center plate 8 and is fitted into gear accommodating hole 27. Rear casing 9 and center plate 8 are fixed to each other by welding.

Formed in the axial-positive side surface of center plate fitting projection 37 are drive shaft through-hole 38 and bearing mounting hole 39. Drive shaft through-hole 38 extends through rear casing 9 in the axial direction of rear casing 9. Second driven-side needle bearing 62 is press-fitted into bearing mounting hole 39.

Disposed on the axial-negative side of bearing mounting hole 39 is driven shaft accommodating hole 40 which is communicated with bearing mounting hole 39. An axial-negative side end portion of driven shaft 52 is disposed in driven shaft accommodating hole 40. Eccentric pin accommodating hole 41 is disposed adjacent to driven shaft accommodating hole 40 in axially parallel therewith. A portion of eccentric pin accommodating hole 41 is merged with driven shaft accommodating hole 40. Second driven-side pressing pin 68 is disposed in eccentric pin accommodating hole 41. A portion of a circumferential surface of second driven-side pressing pin 68 is exposed to driven shaft accommodating hole 40. Second driven-side pressing pin 68 presses driven shaft 52 toward the side of the closing region such that a portion of driven shaft 52 on the side of the closing region and rollers of second driven-side needle bearing 62 are contacted with each other. This function will be explained in detail later.

Formed in the axial-negative side end surface of rear casing 9 is motor fitting portion 45. Motor fitting portion 45 is formed with motor fitting recess 43 into which the motor to drive pump apparatus 1 is fitted. Disposed in a bottom of motor fitting recess 43 is seal accommodating hole 44. Bearing mounting hole 42 is disposed on the axial-positive side of seal accommodating hole 44 and adjacent thereto. Drive shaft through-hole 38 is opened to a bottom of bearing mounting hole 42.

Drive-side ball bearing 61 is press-fitted into bearing mounting hole 42. Pressure reducing seal member 79 is inserted into seal accommodating hole 44 and disposed adjacent to drive-side ball bearing 61 on the axial-negative side of drive-side ball bearing 61. Further, drive-side seal member 65 is inserted into an open end of seal accommodating hole 44 and disposed adjacent to pressure reducing seal member 79 on the axial-negative side of pressure reducing seal member 79.

[Construction of Shaft Seal Member]

Figure 8A:
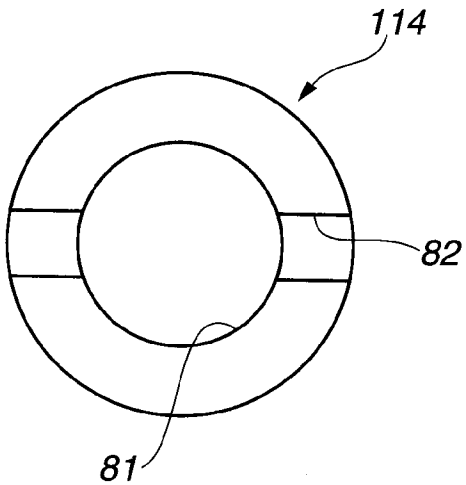
FIG. 8A to FIG. 8C are external views of a holder member for shaft seal members of the pump apparatus according to the first embodiment of the present invention.
Figure 8B:
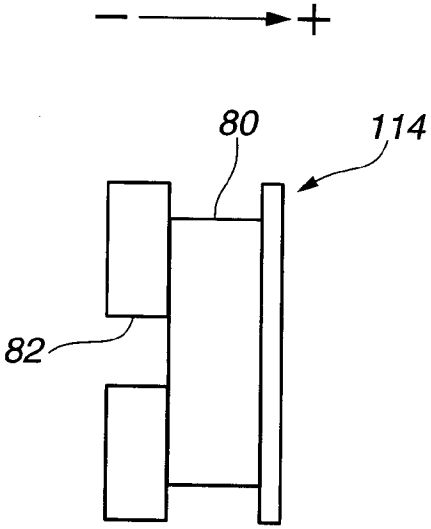
Figure 8C:
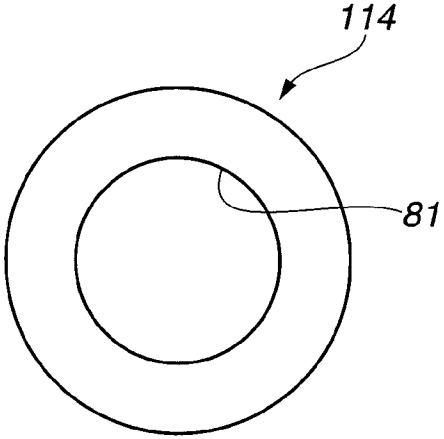

FIG. 8A is an external view of holder member 114 of each of seal members 63, 64 (i.e., drive-side shaft seal member 63 and driven-side shaft seal member 64) when viewed from the axial-negative side. FIG. 8B is an external view of holder member 114 when viewed from a radial outside thereof. FIG. 8C is an external view of holder member 114 when viewed from the axial-positive side.

Holder member 114 is a sleeve-shaped member made of a resin material. As seen from FIG. 2 to FIG. 4 and FIG. 8A to FIG. 8C, holder member 114 has through-hole 81 through which drive shaft 49 or driven shaft 52 extends, and seal groove 80 formed on an outer circumferential surface of holder member 114. Seal groove 80 is disposed at an eccentric position relative to through-hole 81. Seal ring 99 is fitted into seal groove 80 and thereby disposed at an eccentric position relative to through-hole 81. That is, seal ring 99 has an outer circumferential portion projected radially outwardly beyond seal groove 80 such that the amount of projection of the outer circumferential portion of seal ring 99 is varied depending on the position along circumferential direction of seal ring 99. Drive shaft 49 and driven shaft 52 are respectively pressed against through-hole 81 with a force which varies depending on the amount of projection of the outer circumferential portion of seal ring 99. This function will be explained in detail later. Further, shaft seal members 63, 64 serve for blocking communication between first pump chamber 135 and second pump chamber 136.

Holder member 114 has engaging recess 82 in an axial-negative side end portion thereof which is a cutout extending in the axial-negative side end portion in a radial direction of holder member 114. Engaging recess 82 is engaged with engaging projection 83 of respective side plate fitting members 73, 74 as explained later.

[Construction of Side Plate Fitting Member]

Figure 9C:
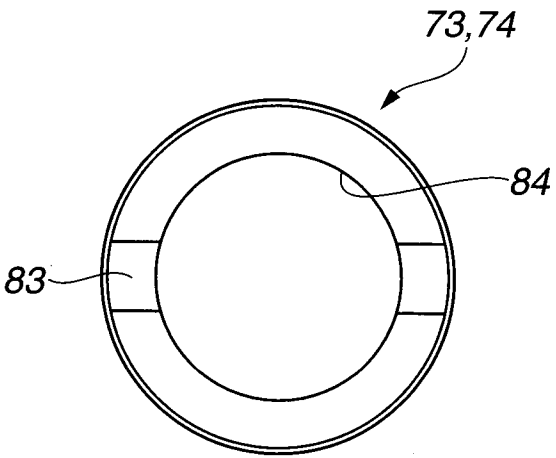
FIG. 9A to FIG. 9C are external views of respective side plate fitting members of the pump apparatus according to the first embodiment of the present invention.
Figure 9B:
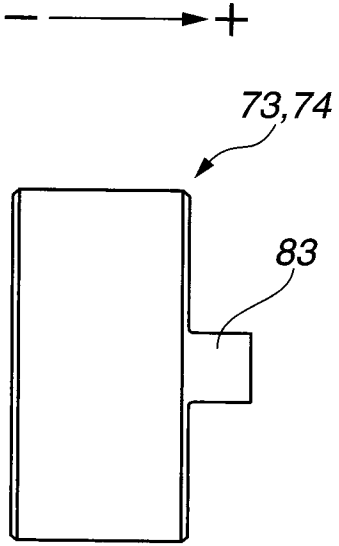
Figure 9A:
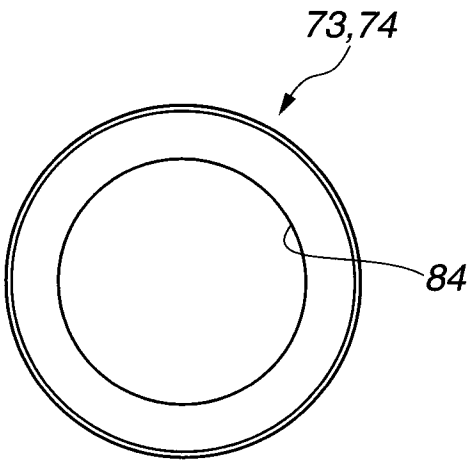

FIG. 9A is an external view of drive-side side plate fitting member 73 and driven-side side plate fitting member 74 when viewed from the axial-negative side. FIG. 9B is an external view of drive-side side plate fitting member 73 and driven-side side plate fitting member 74 when viewed from a radial outside thereof. FIG. 9C is an external view of drive-side side plate fitting member 73 and driven-side side plate fitting member 74 when viewed from the axial-positive side.

As seen from FIG. 11 to FIG. 4 and FIG. 9A to FIG. 9C, side plate fitting members 73, 74 are formed with through-holes 84, 84 through which drive shaft 49 and driven shaft 52 extend, respectively. Through-holes 84, 84 have inner diameters larger than an outer diameter of drive shaft 49 and an outer diameter of driven shaft 52, respectively. Side plate fitting members 73, 74 have engaging projections 83 on axial-positive side side surfaces thereof which extend toward the axial-positive side, respectively. As explained above, engaging projections 83 are engaged with engaging recesses 82 formed in holder members 114 of shaft seal members 63, 64.

Side plate fitting members 73, 74 have outer diameters substantially the same as those of side plate fitting projections 20, 21 of center plate 8, respectively. Side plate fitting members 73, 74 are press-fitted to shaft seal member accommodating holes 29, 30 of center plate 8, respectively, to thereby be prevented from rotating relative to shaft seal member accommodating holes 29, 30. Further, shaft seal members 63, 64 are prevented from rotating relative to shaft seal member accommodating holes 29, 30, respectively, owing to mutual engagement between engaging projections 83 of side plate fitting members 73, 74 and engaging recesses 82 of holder members 114 of shaft seal members 63, 64. Side plate fitting members 73, 74 are fitted into drive side fitting hole 85 and driven side fitting hole 86 of side plate 56, respectively.

[Construction of Side Plate and Seal Block]

Figure 10:
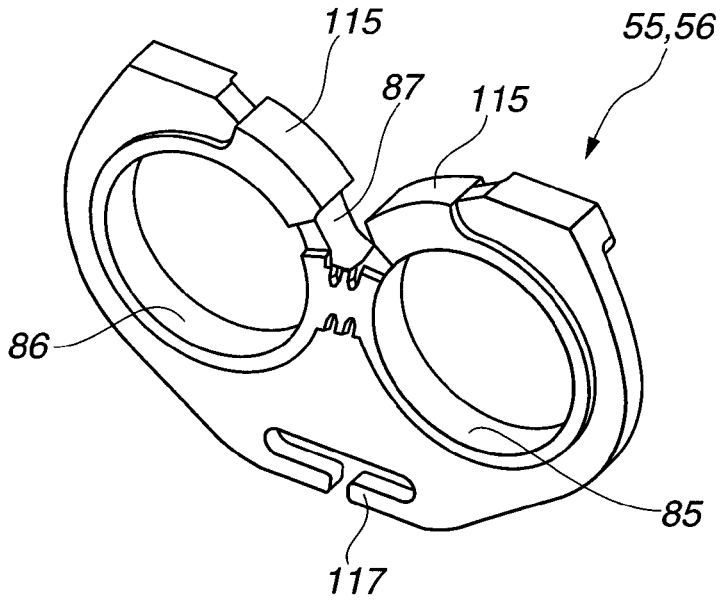
FIG. 10 is a perspective view of respective side plates of the pump apparatus according to the first embodiment of the present invention.
Figure 11:
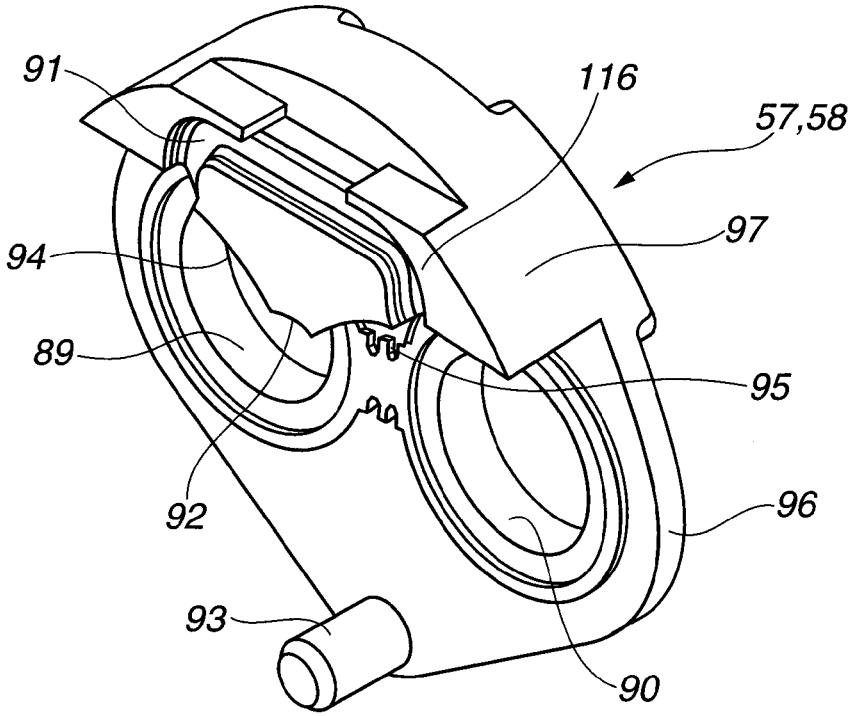
FIG. 11 is a perspective view of respective seal blocks of the pump apparatus according to the first embodiment of the present invention.
Figure 12:
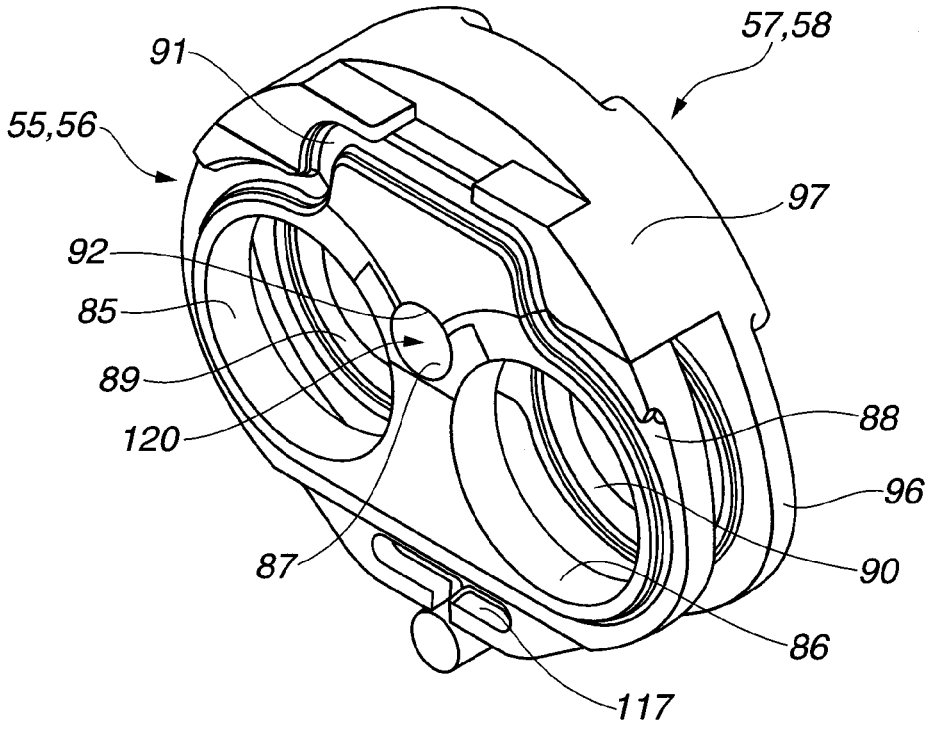
FIG. 12 is a perspective view of a unit assembled from the respective side plates and the respective seal blocks of the pump apparatus according to the first embodiment of the present invention.

FIG. 10 is a perspective view of respective first side plate 55 and second side plate 56. FIG. 11 is a perspective view of respective first seal block 57 and second seal block 58. FIG. 12 is a perspective view of an assembled state of respective side plate 55, 56 and respective seal blocks 57, 58.

As shown in FIG. 2 to FIG. 4, FIG. 10 and FIG. 12, first side plate 55 and second side plate 56 have a generally plate shape, respectively, and are formed with drive-side fitting hole 85 and driven-side fitting hole 86, respectively, which extend through first and second side plates 55, 56. First side plate 55 is fitted onto side plate fitting projections 20, 21 of center plate 8. Second side plate 56 is fitted onto side plate fitting members 73, 74. Fitting holes 85, 86 of first side plate 55 have an inner diameter slightly larger than an outer diameter of side plate fitting projections 20, 21 of center plate 8. Fitting holes 85, 86 of second side plate 56 have an inner diameter slightly larger than an outer diameter of side plate fitting members 73, 74.

Respective first side plate 55 and second side plate 56 have seal surface mating portions 115 and suction groove 87 which are disposed on a radial outside of fitting holes 85, 86. Seal surface mating portions 115 extend toward an intermediate portion between drive-side fitting hole 85 and driven-side fitting hole 86 so as to form an arcuate shape along outer peripheries of fitting holes 85, 86. Suction groove 87 is disposed between seal surface mating portions 115.

Further, respective side plates 55, 56 have fastening seal groove 88 on a side surface which is located on an opposite side of respective seal blocks 57, 58. Fastening seal groove 88 extends so as to surround outer circumferences of fitting holes 85, 86 and has ends opened to seal surface mating portions 115. Respective first side plate 55 and second side plate 56 have elastic engaging portion 117 on an opposite side of seal surface mating portions 115. Elastic engaging portion 117 includes two beams opposed to each other.

As seen from FIG. 2 to FIG. 4, FIG. 11 and FIG. 12, first seal block 57 and second seal block 58 respectively include plate-shaped side plate portion 96 and seal block portions 97 integrally formed with side plate portion 96. First seal block 57 and second seal block 58 are in the form of a molded product made of a resin material. Side plate portion 96 has drive shaft through-hole 89 and driven shaft through-hole 90 through which drive shaft 49 and driven shaft 52 extend, respectively. Suction hole 116 is disposed between drive shaft through-hole 89 and driven shaft through-hole 90, which extends through side plate portion 96 in an axial direction of respective seal blocks 57, 58. Further, side plate portion 96 has cylindrical engaging projection 93 on a surface thereof which is located on the side of center plate 8. Engaging projection 93 extends toward center plate 8.

Seal block portion 97 extends from side plate portion 96 toward center plate 8. Seal block portion 97 has seal surfaces 94, 95 on a side surface thereof which is located on the side of through-holes 89, 90. Respective seal surfaces 94, 95 extend toward an intermediate portion between drive shaft through-hole 89 and driven shaft through-hole 90 so as to form an arcuate shape. Suction groove 92 is disposed at a position where seal surfaces 94, 95 intersect with each other.

First and second seal blocks 57, 58 has seal ring groove 98 on a side surface thereof which is located on an opposite side of center plate 8. Seal ring groove 98 extends so as to surround outer circumferences of drive shaft through-hole 89, driven shaft through-hole 90 and suction hole 116. Front casing-side seal ring 69 is fitted in seal ring groove 98.

As shown in FIG. 12, respective side plate 55, 56 are interposed between seal surfaces 94, 95 and engaging projection 93 of seal blocks 57, 58. In this state, seal surface mating portions 115 of side plates 55, 56 mate with seal surfaces 94, 95, respectively, and central portions of elastic engaging portions 117 of side plates 55, 56 mate with engaging projections 93, respectively. Respective side plate 55, 56 are supported by seal blocks 57, 58 by an elastic force of elastic engaging portion 117.

In an assembled state where side plates 55, 56 are assembled to seal blocks 57, 58, respectively, suction groove 92 of respective seal blocks 57, 58 and suction groove 87 of respective side plates 55, 56 cooperate with each other to form suction hole 120. In addition, in the assembled state where side plates 55, 56 are assembled to seal blocks 57, 58, respectively, fastening seal groove 91 of respective seal blocks 57, 58 and fastening seal groove 88 of respective side plates 55, 56 are communicated with each other. First fastening seal 70 and second fastening seal 71 are mounted into fastening seal groove 88 and fastening seal groove 91, respectively.

As shown in FIG. 2 to FIG. 4, first external gears 109 are disposed between first side plate 55 and first seal block 57. First external gears 109 cooperate with first side plate 55 and first seal block 57 to form first pump chamber 135 therebetween. Second external gears 110 is disposed between second side plate 56 and second seal block 58. Second external gears 110 cooperate with second side plate 56 and second seal block 58 to form second pump chamber 136 therebetween. First pump chamber 135 and second pump chamber 136 are disposed on both sides of center plate 8 in the axial direction of center plate 8.

[Construction of Pressure Reducing Seal]

Figure 13:
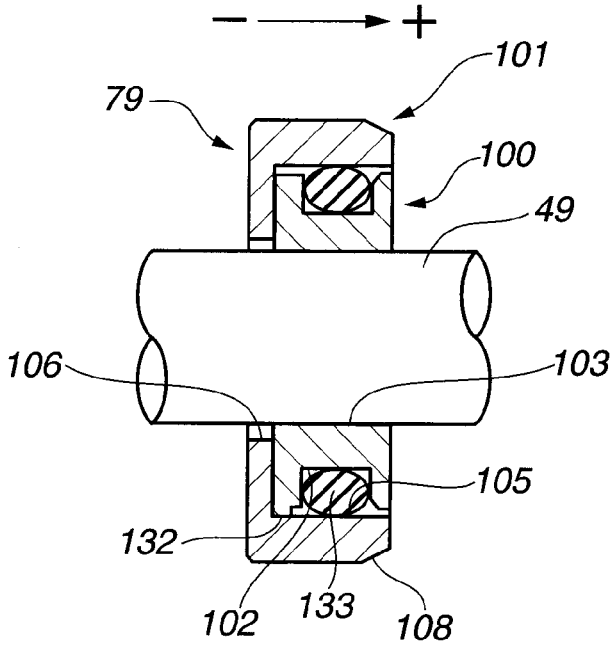
FIG. 13 is an axial cross section of a pressure reducing seal member of the pump apparatus according to the first embodiment of the present invention.
Figure 14:
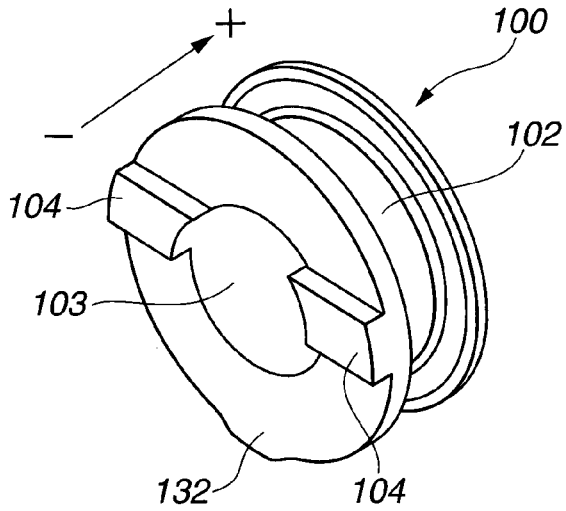
FIG. 14 is a perspective view of an eccentric member of the pump apparatus according to the first embodiment of the present invention.
Figure 15:
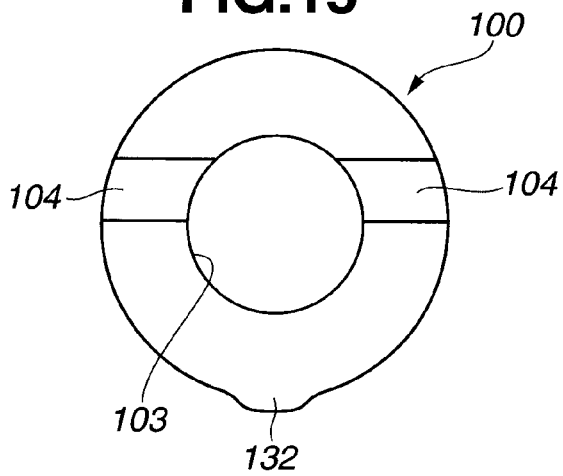
FIG. 15 is a front view of the eccentric member of the pump apparatus according to the first embodiment of the present invention.
Figure 16:
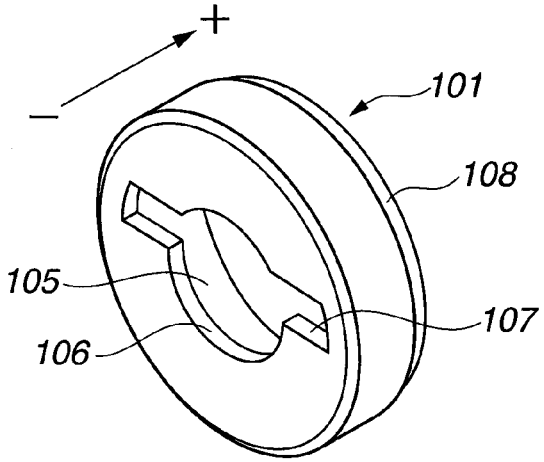
FIG. 16 is a perspective view of a cap member of the pump apparatus according to the first embodiment of the present invention.

FIG. 13 is an axial cross section of pressure reducing seal member 79. FIG. 14 is a perspective view of eccentric member 100. FIG. 15 is a front view of eccentric member 100. FIG. 16 is a perspective view of cap member 101.

As shown in FIG. 2 to FIG. 4 and FIG. 13 to FIG. 15, eccentric member 100 has a generally annular shape having through-hole 103 through which drive shaft 49 extends. Eccentric member 100 has seal ring groove 102 on an outer circumferential surface thereof. Seal ring groove 102 has a generally U-shape in section, into which seal ring 133 is mounted. Eccentric member 100 has detent projections 104 on an axial-negative side end surface thereof which project toward the axial-negative side. Detent projections 104 extend parallel to a radial direction of through-hole 103 and are disposed symmetrically with respect to a line extending through a center of through-hole 103. Further, eccentric member 100 has eccentric projection 132 on a portion of the outer circumferential surface which is located on the axial-negative side.

As shown in FIG. 2 to FIG. 4, FIG. 13 and FIG. 16, cap member 101 has a generally cup shape and includes eccentric member accommodating portion 105 on an inside thereof. Eccentric member 100 with seal ring 133 is accommodated in eccentric member accommodating portion 105 in an eccentric state where eccentric member 100 is allowed to be eccentric with respect to an axis of cap member 101 by eccentric projection 132.

Cap member 101 has through-hole 106 on a bottom thereof, through which drive shaft 49 extends. Further, cap member 101 has detent stop holes 107 on the bottom thereof. Each of detent stop holes 107 is provided in the form of a cutout which radially extends parallel with a radial direction of through-hole 106 and is engaged with each of detent projections 104 of eccentric member 100. Cap member 101 has tapered portion 108 on an outer circumferential surface of an axial-positive side end portion thereof.

Cap member 101 and eccentric member 100 accommodated in cap member 101 are press-fitted into seal accommodating hole 44 of rear casing 9. Owing to the engagement of detent projections 104 of eccentric member 100 in detent holes 107 of cap member 101, eccentric member 100 is prevented from rotating relative to rear casing 9. Pressure reducing member 79 presses drive shaft 49 toward the closing region such that a portion of driven shaft 52 on the side of the closing region and drive-side ball bearing 61 are brought into contact with each other. This function will be explained in detail later.

[Constructions of Drive Shaft, Driven Shaft, Drive Gear and Driven Gear]

As shown in FIG. 2 and FIG. 4, drive shaft 49 has pin hole 121 at the position where first drive gear 50 is mounted, and pin hole 122 at the position where second drive gear 51 is mounted. Driven shaft 52 has pin hole 123 at the position where first driven gear 53 is mounted, and pin hole 124 at the position where second driven gear 54 is mounted. First drive gear retaining pin 75, second drive gear retaining pin 76, first driven gear retaining pin 77 and second driven gear retaining pin 78 are press-fitted to pin holes 121, 122, 123 and 124.

As shown in FIG. 4, first drive gear 50 has through-hole 128 through which drive shaft 49 extends, and second drive gear 51 has through-hole 129 through which drive shaft 49 extends. First and second drive gears 50, 51 have pin engaging portions 134, 125, respectively. Pin engaging portions 134, 125 are provided in the form of cutouts which extend in a radial direction of first and second drive gears 50, 51 so as to be communicated with through-holes 128, 129, respectively. First drive gear retainer pin 75 is engaged in pin engaging portion 134, and second drive gear retainer pin 76 is engaged in pin engaging portion 125.

First driven gear 53 has through-hole 130 through which driven shaft 52 extends, and second driven gear 54 has through-hole 131 through which driven shaft 52 extends. First and second driven gears 53, 54 have pin engaging portions 126, 127, respectively. Pin engaging portions 126, 127 are provided in the form of cutouts which extend in a radial direction of first and second driven gears 53, 54 so as to be communicated with through-holes 130, 131, respectively. First driven gear retainer pin 77 is engaged in pin engaging portion 126, and second driven gear retainer pin 78 is engaged in pin engaging portion 127.

[Assembly of Pump Apparatus]

An assembling operation of pump apparatus 1 will be explained hereinafter by referring to FIG. 2 to FIG. 4.

(Center Plate Assembly)

First, drive-side shaft seal member 63 is inserted into shaft seal accommodating hole 29 of center plate 8, and then, drive-side side plate fitting member 73 is press-fitted into shaft seal accommodating hole 29. Similarly, driven-side shaft seal member 64 is inserted into shaft seal accommodating hole 30 of center plate 8, and then, driven-side side plate fitting member 74 is press-fitted into shaft seal accommodating hole 30. Upon inserting drive-side shaft seal member 63, an eccentric direction of drive-side shaft seal member 63 is adjusted to bias drive shaft 49 such that drive gears 50, 51 on drive shaft 49 are allowed to press against drive-side seal surface 94 of respective seal blocks 57, 58 which are assembled to drive shaft 49 later. Similarly, upon inserting driven-side shaft seal member 64, an eccentric direction of driven-side shaft seal member 64 is adjusted to bias driven shaft 52 such that driven gears 53, 54 on driven shaft 52 are allowed to press against driven-side seal surface 59 of respective seal blocks 57, 58 which are assembled to driven shaft 52 later.

Next, first side plate 55 and second side plate 56 are assembled to center plate 8 together with first fastening seal 70 and second fastening seal 71. After that, drive shaft 49 and driven shaft 52 are assembled to center plate 8, and drive gear retainer pins 75, 76 and driven gear retainer pins 77, 78 are assembled to drive shaft 49 and driven shaft 52, respectively.

Subsequently, seal blocks 57, 58 are assembled to drive shaft 49 and driven shaft 52, respectively. In this assembled state, drive gears 50, 51 are pressed against drive-side seal surface 94 of respective seal blocks 57, 58 through drive shaft 49 by drive-side shaft seal member 63. Driven gears 53, 54 are pressed against driven-side seal surface 95 of respective seal blocks 57, 58 through driven shaft 52 by driven-side shaft seal member 64. That is, drive gears 50, 51 and driven gears 53, 54 are disposed in an eccentric state with respect to central axes of drive shaft through-hole 22 and driven shaft through-hole 23. As a result, in the assembled state, tooth tip of respective drive gears 50, 51 are brought into abutting contact with seal surfaces 94 of seal blocks 57, 58, and tooth tip of respective driven gears 53, 54 are brought into abutting contact with seal surfaces 95 of seal blocks 57, 58. Upon assembling seal blocks 57, 58, seal blocks 57, 58 are assembled to drive shaft 49 and driven shaft 52 while pressing seal surfaces 94, 95 against drive gears 50, 51 and driven gears 53, 54 in such a direction as to reduce the eccentric amount of drive gears 50, 51 and driven gears 53, 54 with respect to central axes of drive shaft through-hole 22 and driven shaft through-hole 23. Engaging projections 93 of seal blocks 57, 58 are brought into engagement with seal block engaging holes 118, 119 of center plate 8, respectively, so that drive gears 50, 51 and driven gears 53, 54 are held in the pressed state against seal surfaces 94, 95 of seal blocks 57, 58, respectively.

Finally, O-ring 112 is mounted into seal groove 26 of center plate 8.

(Front Casing Assembly)

Drive-side pressing pin 66 is press-fitted into eccentric pin accommodating hole 17 of front casing 7, and first driven-side pressing pin 67 is press-fitted into eccentric pin accommodating hole 48 of front casing 7. After that, drive-side needle bearing 59 is press-fitted into bearing mounting hole 15 of front casing 7, and first driven side needle bearing 60 is press-fitted into bearing mounting hole 46 of front casing 7.

Finally, O-ring 111 is mounted into seal groove 12 of front casing 7.

(Rear Casing Assembly)

Drive-side ball bearing 61 is press-fitted into bearing mounting hole 42 of rear casing 9. Next, pressure reducing seal member 79 is press-fitted into seal accommodating hole 44 of rear casing 9. Upon press-fitting pressure reducing seal member 79, an eccentric direction of pressure reducing seal member 79 is adjusted such that drive shaft 49 is pressed toward the side of the closing region of first external gear 109 and second external gear 110. Subsequently, drive-side seal member 65 is inserted from the axial-negative side into seal accommodating hole 44.

Next, second driven-side pressing pin 68 is press-fitted into eccentric pin accommodating hole 41 of rear casing 9, and second driven-side needle bearing 62 is press-fitted into bearing mounting hole 39 of rear casing 9.

Finally, O-ring 113 is mounted into seal groove 35 of rear casing 9.

(Assembling Operation of Assemblies)

The front casing assembly and the rear casing assembly are assembled to the center plate assembly. After assembling, drive shaft 49 and driven shaft 52 linearly extend through the center plate assembly, the front casing assembly and the rear casing assembly, respectively. In this assembled state, drive shaft 49 and driven shaft 52 are pressed by pressing pins 66, 67 in the front casing assembly, pressed by shaft seal members 63, 64 in the center plate assembly, and pressed by pressing pin 68 and pressure reducing seal 79 in the rear casing assembly. As a result, in the assembled state of the center plate assembly, the front casing assembly and the rear casing assembly, axes of the front casing assembly, the center plate assembly and the rear casing assembly are offset relative to central axes of drive shaft 49 and driven shaft 52. The front casing assembly, the center plate assembly and the rear casing assembly which are assembled in the offset state are welded to each other to form pump apparatus 1 as one unit. In other words, upon assembling the front casing assembly, the center plate assembly and the rear casing assembly to each other, positions of these assemblies relative to drive shaft 49 and driven shaft 52 extending over these assemblies are adjusted to perform centering of the axes of these assemblies relative to drive shaft 49 and driven shaft 52 which extend over these assemblies.

[Function of Pressing Shafts by Shaft Seal Members, Eccentric Pins, Pressure Reducing Seal Member]

Figure 17:
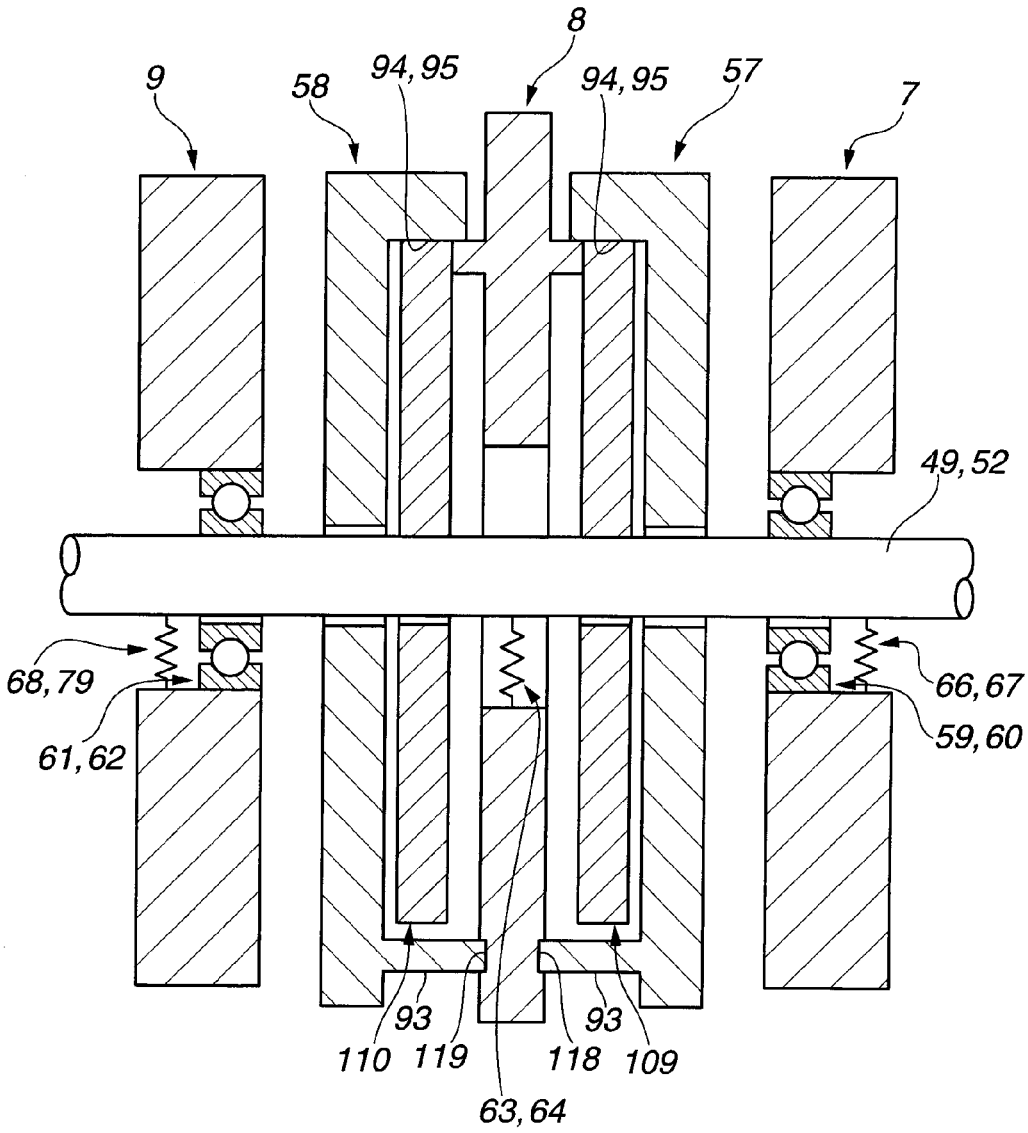
FIG. 17 is a schematic diagram showing the pump apparatus according to the first embodiment of the present invention.

FIG. 17 is a schematic diagram showing pump apparatus 1. Shaft seal members 63, 64 act to apply a pressing force between external gears 109, 110 and seal surfaces 94, 95 of seal blocks 57, 58 in the closing region of drive shaft 49 and driven shaft 52. Pressing pins 66, 67, 68 and pressure reducing seal member 79 are disposed closer to opposite axial ends of respective shafts 49, 52 than respective bearings 59, 60, 61, 62 in the axial direction of respective shafts 49, 52, such that an inner circumferential surface of respective bearings 59, 61 is brought into contact with an outer circumferential surface of drive shaft 49 and an inner circumferential surface of respective bearings 60, 62 is brought into contact with an outer circumferential surface of driven shaft 52.

[Positional Relationship Between Parts]

Figure 18A:
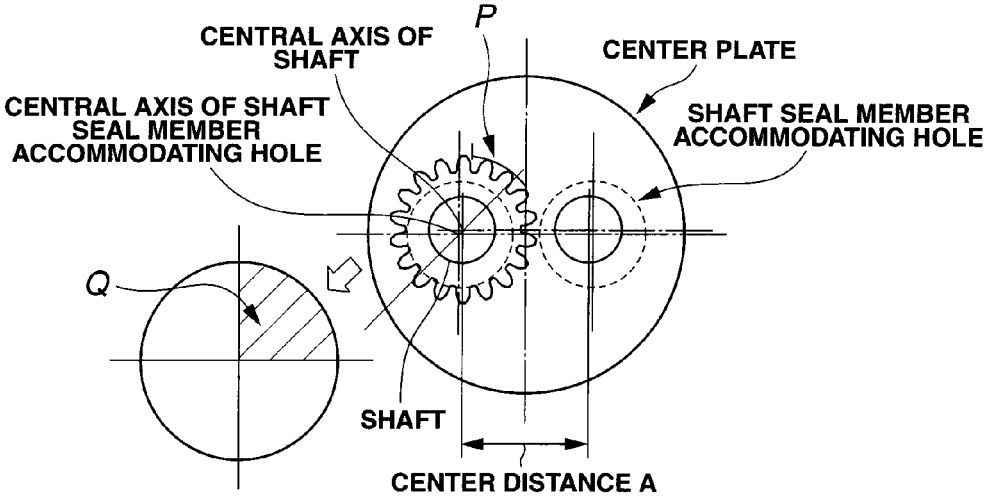
FIG. 18A to FIG. 18C are explanatory diagrams showing a positional relationship between respective parts of the pump apparatus according to the first embodiment of the present invention.

FIG. 18A to FIG. 20 are explanatory diagrams showing a positional relationship between parts of pump apparatus 1. FIG. 18A to FIG. 18C are explanatory diagrams showing an unassembled state of pump apparatus 1 (i.e., before assembling pump apparatus 1) in which the front casing assembly and the rear casing assembly are not assembled to the center plate assembly.

Figure 18B:
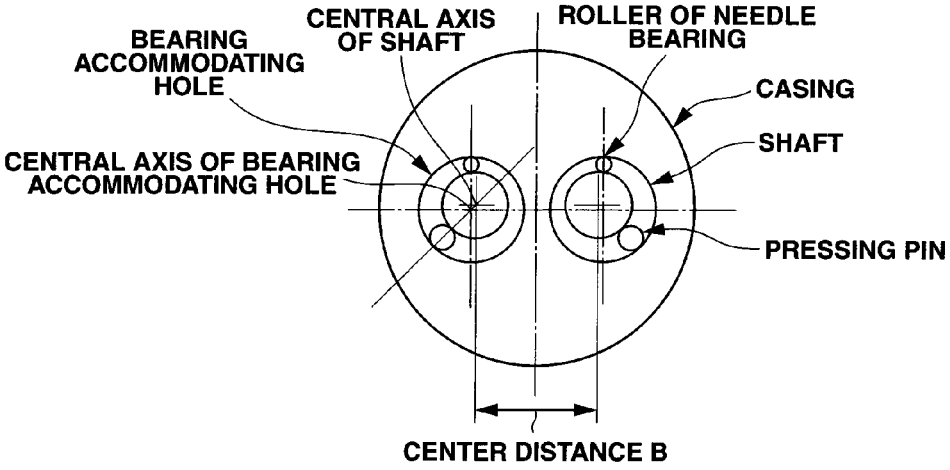
Figure 18C:
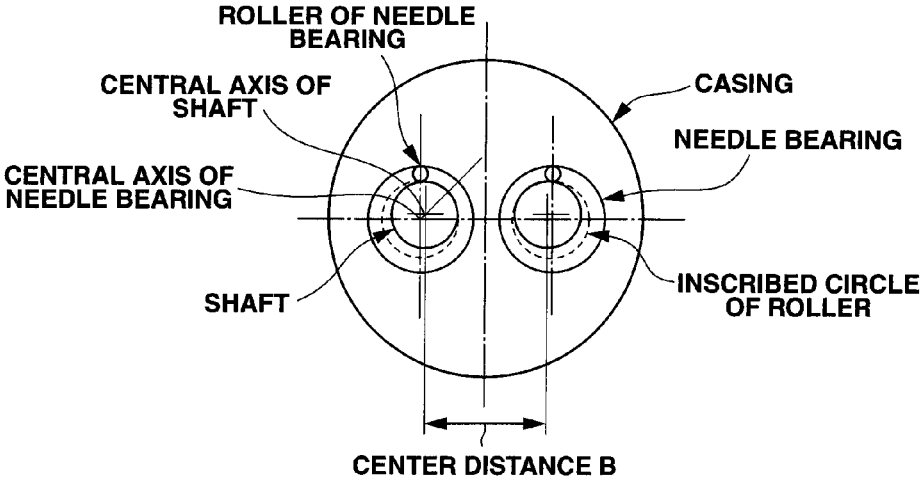

FIG. 18A shows a positional relationship between center plate 8, drive shaft 49, driven shaft 52, drive gears 50, 51, driven gears 53, 54 and seal surfaces 94, 95 of seal blocks 57, 58. FIG. 18B shows a positional relationship between front casing 7, rear casing 9, drive shaft 49, driven shaft 52 and pressing pins 66, 67, 68. FIG. 18C shows a positional relationship between front casing 7, rear casing 9, drive shaft 49, driven shaft 52 and rollers of needle bearings 59, 60, 62. Although drive shaft 49 and driven shaft 52 are not actually inserted into front casing 7 and rear casing 9 in the unassembled state of pump apparatus 1, FIG. 18B and FIG. 18C show the positional relationship on the assumption that drive shaft 49 and driven shaft 52 are inserted into front casing 7 and rear casing 9.

Figure 19A:
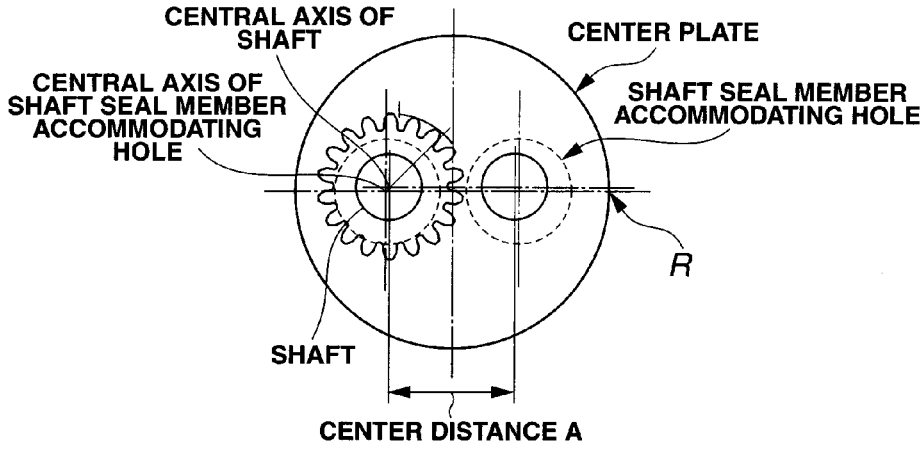
FIG. 19A to FIG. 19C are explanatory diagrams showing a positional relationship between respective parts of the pump apparatus according to the first embodiment of the present invention.
Figure 19B:
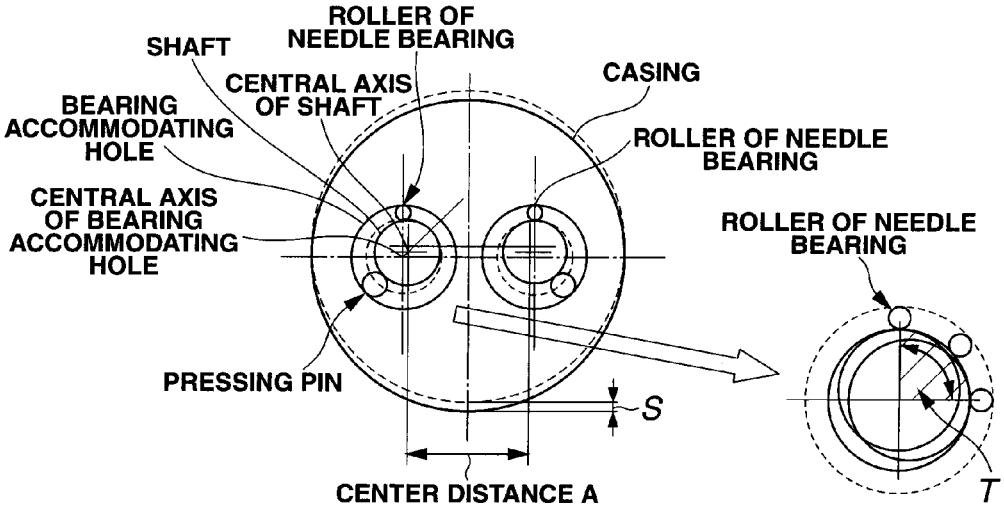
Figure 19C:
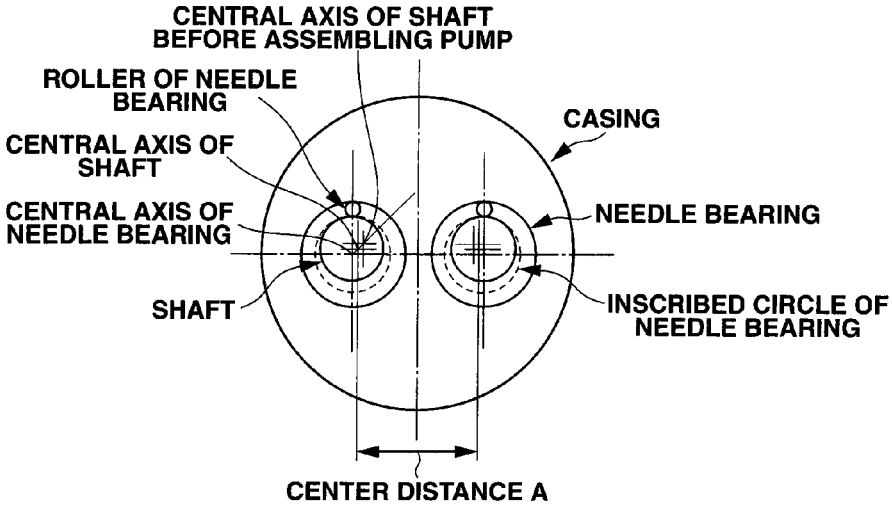
Figure 20:
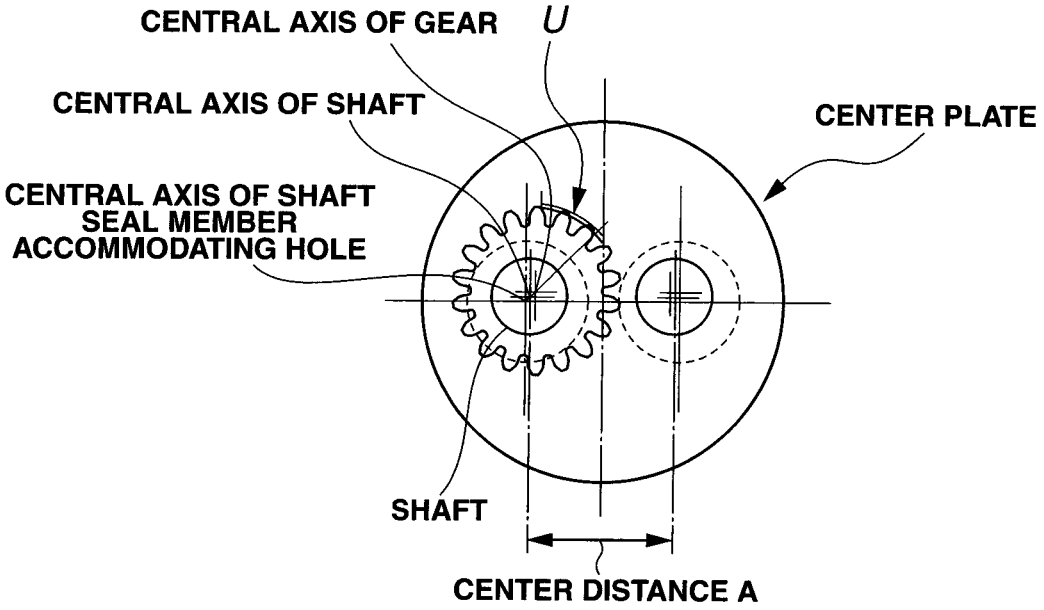
FIG. 20 is an explanatory diagram showing a positional relationship between respective parts of the pump apparatus according to the first embodiment of the present invention.

FIG. 19A to FIG. 19C are explanatory diagrams showing an assembled state of pump apparatus 1 (i.e., after assembling pump apparatus 1) in which the front casing assembly and the rear casing assembly are assembled to the center plate assembly. FIG. 19A shows a positional relationship between center plate 8, drive shaft 49, driven shaft 52, drive gears 50, 51, driven gears 53, 54 and seal surfaces 94, 95 of seal blocks 57, 58. FIG. 19B shows a positional relationship between front casing 7, rear casing 9, drive shaft 49, driven shaft 52 and pressing pins 66, 67, 68. FIG. 19C shows a positional relationship between front casing 7, rear casing 9, drive shaft 49, driven shaft 52 and rollers of needle bearings 59, 60, 62. FIG. 20 shows a positional relationship between center plate 8, drive shaft 49, driven shaft 52, drive gears 50, 51, driven gears 53, 54 and seal surfaces 94, 95 of seal blocks 57, 58 after pump apparatus 1 is driven to allow drive gears 50, 51 and driven gears 53, 54 to scrape seal surfaces 94, 95 of seal blocks 57, 58 (that is, after abutment is carried out).

For the sake of simple illustration, in the following description, drive shaft 49 and driven shaft 52 are referred to merely as shafts, and drive gears 50, 51 and driven gears 53, 54 are referred to merely as gears. Further, reference numerals of the respective parts are omitted, and explanation for drive-side ball bearing 61 is omitted. FIG. 18A to FIG. 20 are schematic diagrams, in which reference numerals are omitted.

(Before Assembling Pump Apparatus)

As shown in FIG. 18A, the shafts are biased by the shaft seal members so as to press the gears toward the seal surfaces of seal blocks, respectively. The seal blocks are fixed to a center plate while keeping the seal surfaces pressed against tooth tips of the gears as indicated by arrow P in FIG. 18A. Assuming that the shaft seal member accommodating holes are unit circles in coordinate planes which have centers aligned with central axes of the shaft seal member accommodating holes, respectively, a central axis of one of the shafts disposed in the shaft seal member accommodating holes is located in the first quadrant of the unit circle as indicated by arrow Q in FIG. 18A. In this condition, a center distance between the central axes of the shafts is indicated by A as shown in FIG. 18A.

As shown in FIG. 18B and FIG. 18C, assuming that the bearing mounting holes are unit circles in coordinate planes which have centers aligned with central axes of the bearing mounting holes, respectively, the shafts are biased toward the side of the closing region by the pressing pins in the bearing mounting holes so that the central axes of the shafts further become eccentric with respect to central axes of the unit circles, respectively. In this condition, the side of the closing region indicates the side of the first quadrant and the second quadrant of the respective unit circles. As a result, outer circumferences of the shafts and inscribed circles of rollers of needle bearings (i.e., circular lines formed by connecting radially inner-most points of the adjacent rollers of the needle bearings, respectively) can be contacted with each other. In this condition, a center distance between the central axes of the shafts is indicated by B as shown in FIG. 18B and FIG. 18C, which is shorter than the center distance A.

(After Assembling Pump Apparatus)

As shown in FIG. 19A, when the seal blocks are fixed to the center plate, seal rings of the shaft seal members are deformed so that the central axes of the shafts are downwardly displaced relative to central axes of shaft seal member accommodating holes as indicated by arrow R.

As shown in FIG. 19B and FIG. 19C, the shafts move along the inscribed circles of rollers of respective needle bearings while keeping the center distance A defined on the side of the center plate assembly. At this time, the movements of the shafts in a direction perpendicular to the central axes of the shafts are caused due to a relative offset in position between the center plate and the casing which is indicated as difference S in outer diameter between the center plate and the casing as shown in FIG. 19B. If the central axis of one of the shafts is located in the first quadrant of the unit circle in the coordinate plane which has a center aligned with the central axis of the shaft seal member accommodating hole in the center plate assembly before assembling the pump apparatus, the central axis of the one of the shafts can also be located in the first quadrant of the unit circle in the coordinate plane which has a center aligned with the central axis of the bearing mounting hole in the casing assembly even after assembling the pump apparatus. As a result, an outer circumference of the one of the shafts and the inscribed circle of rollers of the needle bearing in the bearing mounting hole can be always contacted with each other in the first quadrant of the unit circle in the coordinate plane which has a center aligned with the central axis of the bearing mounting hole as indicated by T in FIG. 19B.

(After Abutment)

After an assembling operation of the pump apparatus is completed, the seal surfaces of the respective seal blocks are brought into abutting contact with the tooth tips of the gears only by an amount of a clearance between an inner diameter of the respective gears and an outer diameter of the respective shafts as indicated by arrow U in FIG. 20. The center distance A is kept even after completing the abutment operation.

[Eccentricity of Gears]

Figure 21A:
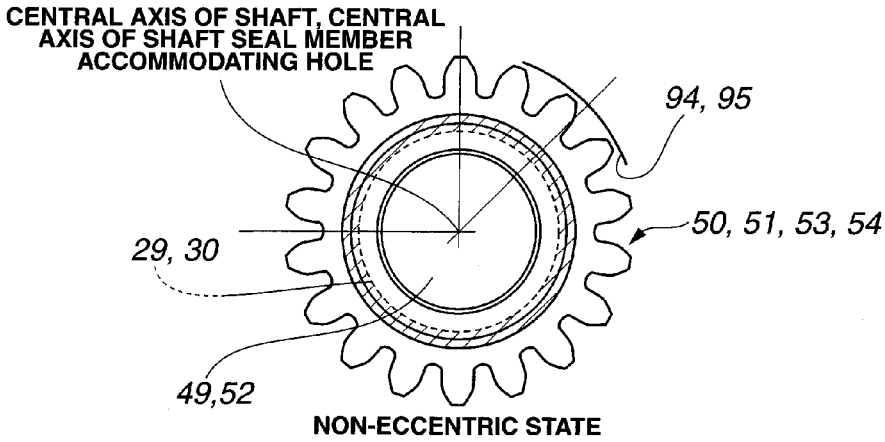
FIG. 21A to FIG. 21C are explanatory diagrams showing an eccentric state of respective gears relative to respective shaft seal member accommodating holes of the pump apparatus according to the first embodiment of the present invention.
Figure 21B:
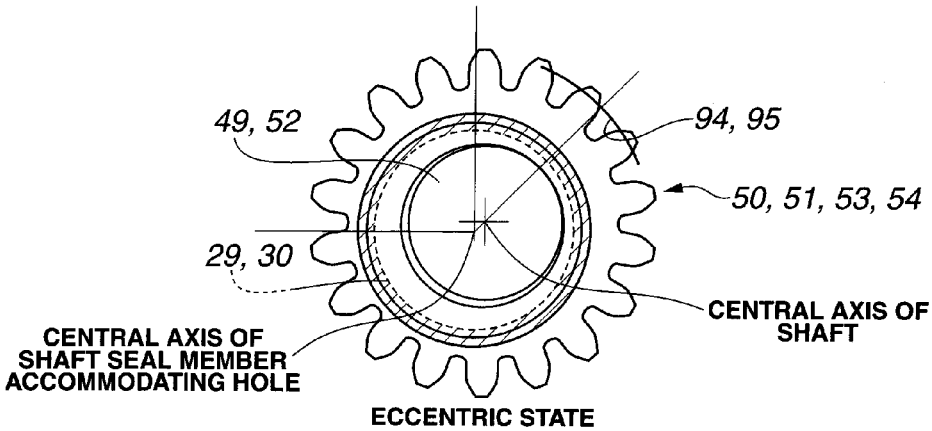
Figure 21C:
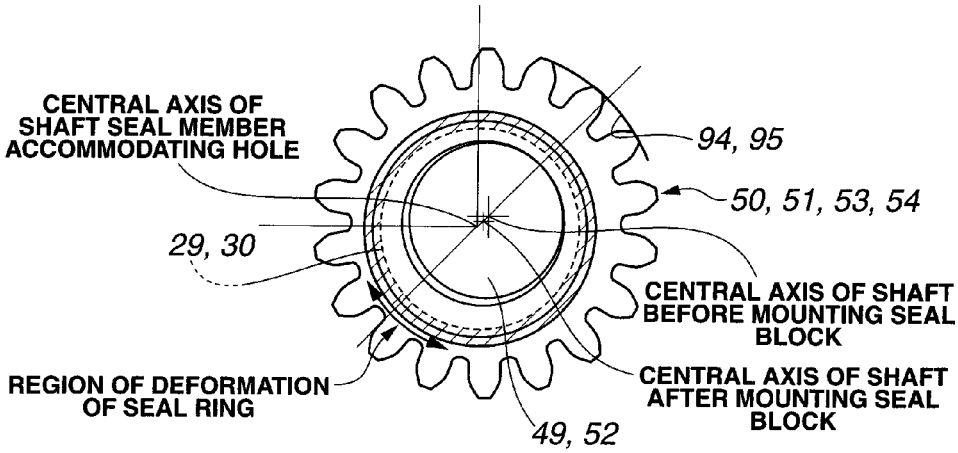

FIG. 21A to FIG. 21C are explanatory diagrams relating to eccentricity of gears 50, 51, 53, 54 with respect to shaft seal member accommodating holes 29, 30. FIG. 21A shows gears 50, 51 and 53, 54 which are not eccentric with respect to shaft seal member accommodating holes 29 and 30, respectively. FIG. 21B shows gears 50, 51 and 53, 54 which are eccentric with respect to shaft seal member accommodating holes 29 and 30 by shaft seal members 63 and 64, respectively. FIG. 21C shows gears 50, 51 and 53, 54 when seal blocks 57, 58 are fixed to center plate 8.

As shown in FIG. 21A, before gears 50, 51, 53, 54 are allowed to be eccentric with respect to the corresponding shaft seal member accommodating holes 29, 30, tooth tips of respective gears 50, 51, 53, 54 and seal surfaces 94, 95 of respective seal blocks 57, 58 are spaced apart from each other. As shown in FIG. 21B, when gears 50, 51, 53, 54 are allowed to be eccentric with respect to the corresponding shaft seal member accommodating holes 29, 30 by shaft seal members 63, 64, tooth tips of respective gears 50, 51, 53, 54 are bitten into seal surfaces 94, 95. As shown in FIG. 21C, when seal blocks 57, 58 are fixed to center plate 8, an eccentric amount of respective gears 50, 51, 53, 54 relative to the corresponding shaft seal member accommodating holes 29, 30 is reduced.

[Functions]

Conventionally, in order to perform positioning of a drive shaft and a driven shaft with high accuracy, a dimensional accuracy of parts has been increased and positioning of seal blocks and side plates relative to a center plate and a casing has been carried out using locating pins or the like. However, if the dimensional accuracy of parts is enhanced, an assembling efficiency will be lowered. On the other hand, if the dimensional accuracy of parts is reduced in consideration of the assembling efficiency, there will occur a clearance between the respective shafts and the respective bearing holes. Due to occurrence of the clearance, shafts and gears supported on the shafts are displaceable relative to the shaft accommodating holes to thereby cause a leakage of working oil and reduction in pump efficiency.

In contrast, pump apparatus 1 according to the first embodiment includes shaft seal members 63, 64 which apply a pressing force between tooth tips of gears 50, 51, 53, 54 and seal surfaces 94, 95 of seal block portions 97 of seal blocks 57, 58 in the closing region disposed between gears 50, 51, 53, 54 and seal block portions 97, respectively, such that tooth tips of gears 50, 51, 53, 54 and seal surfaces 94, 95 of seal block portions 97 are allowed to press against each other. Further, inner circumferential surfaces of bearings 59, 61 and 60, 62 and outer circumferential surfaces of drive shaft 49 and driven shaft 52 are kept in contact with each other on the side of the closing region, while the tooth tips of respective gears 50, 51, 53, 54 and seal surfaces 94, 95 of seal block portion 97 in the closing region are kept pressed against each other by shaft seal members 63, 64.

As a result, even in a case where the parts have a relatively low dimensional accuracy, it is possible to ensure the contact between the tooth tips of respective gears 50, 51, 53, 54 and seal surfaces 94, 95 of seal block portion 97 and the contact between the inner circumferential surfaces of bearings 59, 61 and the outer circumferential surface of drive shaft 49 and between the inner circumferential surfaces of bearings 60, 62 and the outer circumferential surface of driven shaft 52. Accordingly, pump apparatus 1 can be enhanced in assemblability, and displacement of drive shaft 49, driven shaft 52 and respective gears 50, 51, 53, 54 can be suppressed to thereby increase a pump efficiency.

Further, in pump apparatus 1 according to the first embodiment, assuming that the closing region is located in the first quadrant of a coordinate plane which has a center aligned with a central axis of respective bearing mounting holes 15, 46, 42, 39, the contact between the inner circumferential surface of respective bearings 59, 61 and the outer circumferential surface of drive shaft 49 and the contact between the inner circumferential surface of respective bearings 60, 62 and the outer circumferential surface of driven shaft 52 can be established in the first quadrant and/or the second quadrant of the coordinate plane.

Further, with the provision of shaft seal members 63, 64, a pressing force is applied between the tooth tips of respective gears 50, 51, 53, 54 and seal surfaces 94, 95 of seal block portion 97 of respective seal blocks 57, 58 in the closing region. That is, shaft seal members 63, 64 press drive shaft 49 and driven shaft 52 toward sides of the first quadrant and the second quadrant, respectively. By contacting the inner circumferential surface of respective bearings 59, 61 and the outer circumferential surface of drive shaft 49 in the first quadrant and/or contacting the inner circumferential surface of respective bearings 60, 62 and the outer circumferential surface of driven shaft 52 in the second quadrant, it is possible to establish the contact between the tooth tips of gears 50, 51, 53, 54 and seal surfaces 94, 95 of seal block portion 97 of respective seal blocks 57, 58 in the closing region, and at the same time, establish the contact between the inner circumferential surface of respective bearings 59, 61 and the outer circumferential surface of drive shaft 49 and the contact between the inner circumferential surfaces of bearings 60, 62 and the outer circumferential surface of driven shaft 52.

Further, in pump apparatus 1 according to the first embodiment, shaft seal members 63, 64 are used as a pressing mechanism for pressing drive shaft 49 and driven shaft 52. Shaft seal members 63, 64 are disposed between an inner circumferential surface of drive shaft through-hole 22 and an outer circumferential surface of drive shaft 49, and between an inner circumferential surface of driven shaft through-hole 23 and an outer circumferential surface of driven shaft 52, respectively. Shaft seal members 63, 64 serve for blocking fluid communication between first pump chamber 135 and second pump chamber 136.

Since shaft seal members 63, 64 have both the pressing function and the sealing function, it is possible to reduce the number of parts.

Further, pump apparatus 1 according to the first embodiment includes a clearance reducing mechanism which is constituted of pressing pins 66, 67, 68 and pressure reducing seal member 79. Pressing pins 66, 67 are disposed between bearing mounting hole 15 of front casing 7 and drive shaft 49 and between bearing mounting hole 46 of front casing 7 and driven shaft 52, respectively. Pressing pin 68 is disposed between bearing mounting hole 39 of rear casing 9 and driven shaft 52. Pressure reducing seal member 79 is disposed between bearing mounting hole 42 of rear casing 9 and drive shaft 49. With the provision of pressing pins 66, 67, 68 and pressure reducing seal member 79, the inner circumferential surface of respective bearings 59, 61 and the outer circumferential surface of drive shaft 49 can be contacted with each other, and the inner circumferential surface of respective bearings 60, 62 and the outer circumferential surface of driven shaft 52 can be contacted with each other.

As a result, upon assembling front casing 7 and rear casing 9 to center plate 8, self-centering of drive shaft 49 and driven shaft 52 can be carried out using pressing pins 66, 67, 68 and pressure reducing seal member 79 to thereby establish the contact between the inner circumferential surfaces of bearings 59, 61 and the outer circumferential surface of drive shaft 49 and between the inner circumferential surfaces of bearings 60, 62 and the outer circumferential surface of driven shaft 52.

Further, in pump apparatus 1 according to the first embodiment, seal block portion 97 of respective seal blocks 57, 58 are integrally formed with side plate portion 96 of respective seal blocks 57, 58. First seal block 57 is held in the position relative to center plate 8 in which seal surfaces 94, 95 of seal block portion 97 are contacted with tooth tips of first external gears 109. Second seal block 58 is held in the position relative to center plate 8 in which seal surfaces 94, 95 of seal block portion 97 are contacted with tooth tips of second external gears 110.

With this arrangement, the number of parts can be reduced, and the center plate assembly in which first and second seal blocks 57, 58 are fixed to center plate 8 can be provided to thereby enhance an assemblability of pump apparatus 1.

Further, in pump apparatus 1 according to the first embodiment, first and second seal blocks 57, 58 are made of a resin material. Therefore, it is possible to readily obtain first and second seal blocks 57, 58 each having a complicated shape by a molding method.

Further, in pump apparatus 1 according to the first embodiment, with the provision of seal rings 99 mounted on shaft seal members 63, 64, drive shaft 49 and driven shaft 52 are allowed to be eccentric relative to drive shaft through-hole 22 and driven shaft through-hole 23, thereby biasing drive gears 50, 51 and driven gears 53, 54 in the radial direction thereof so as to reduce a clearance between tooth tips of drive gears 50, 51 and seal surfaces 94, 95 of seal block portion 97 and a clearance between tooth tips of driven gears 53, 54 and seal surfaces 94, 95 of seal block portion 97.

Accordingly, with the provision of seal rings 99, it is possible to allow shaft seal members 63, 64 to have not only a sealing function but also a pressing function and thereby reduce the number of parts.

Further, in pump apparatus 1 according to the first embodiment, pressing pins 66 and pressure reducing seal member 79 are arranged closer to opposite axial ends of drive shaft 49 than respective bearings 59, 61 in the axial direction of drive shaft 49. Similarly, pressing pins 67, 68 are arranged closer to opposite axial ends of driven shaft 52 than respective bearings 60, 62 in the axial direction of driven shaft 52.

With this arrangement, it is possible to ensure a sufficient distance between shaft seal member 63 and pressing pin 66 and pressure reducing seal member 79 and a sufficient distance between shaft seal member 64 and pressing pins 67, 68. Therefore, the pressing force of pressing pins 66, 67, 68 and pressure reducing seal member 79 has a less influence on the pressing direction of shaft seal members 63, 64. As a result, it is possible to reduce a clearance between gears 50, 51 and seal surfaces 94 of seal blocks 57, 58 and a clearance between gears 53, 54 and seal surfaces 95 of seal blocks 57, 58.

Further, in pump apparatus 1 according to the first embodiment, first drive gear 50 and second drive gear 51 are biased in the same radial direction thereof. Therefore, both first drive gear 50 and second drive gear 51 can be biased by pressing single drive shaft 49.

Further, in pump apparatus 1 according to the first embodiment, a plurality of wheel cylinders can be pressurized by pumping action of first pump chamber 135 and second pump chamber 136. With this construction, two pump chambers can be provided in single pump apparatus 1, thereby serving for downsizing a brake apparatus as a whole.

Further, in pump apparatus 1 according to the first embodiment, shaft seal member 63 is biased toward the closing region of drive shaft 49. Shaft seal member 63 is disposed between the outer circumferential surface of drive shaft 49 and an inner circumferential surface of shaft seal member accommodating hole 29 into which shaft seal member 63 is inserted. With this construction, it is possible to ensure the contact between tooth tips of respective drive gears 50, 51 and seal surfaces 94, 95 of seal block portion 97 of respective seal blocks 57, 58.

Further, a method of assembling pump apparatus 1 according to the first embodiment includes a drive shaft assembling step, a pump sub-assembling step and a pump assembling step. In the drive shaft assembling step, drive shaft 49 which is to be driven by a motor is assembled to center plate 8 such that a central axis of drive shaft 49 is allowed to be eccentric with respect to drive shaft through-hole 22 so as to project tooth tips of drive gears 50, 51 mounted on drive shaft 49 beyond seal surfaces 94, 95 of seal blocks 57, 58 which are to be assembled in the subsequent pump sub-assembling step and seal the tooth tips. In the pump sub-assembling step after completing the drive shaft assembling step, seal blocks 57, 58 are assembled to center plate 8 to carry out positioning thereof relative to center plate 8 such that an amount of projection of the tooth tips of drive gears 50, 51 with respect to seal surfaces 94, 95 is reduced. In the pump assembling step after completing the pump sub-assembling step, drive shaft 49 assembled to center plate 8 is supported by front casing 7 and rear casing 9 while carrying out centering of drive shaft 49.

By the method of assembling pump apparatus 1, seal blocks 57, 58 can be fixed to center plate 8 while keeping seal surfaces 94, 95 of seal blocks 57, 58 in contact with drive gears 50, 51. As a result, pump apparatus 1 can be enhanced in assemblability.

Further, in the above method, the pump assembling step is carried out using bearings 59, 61 disposed in front casing 7 and rear casing 9, respectively, and pressing pin 66 and pressure reducing seal member 79 which are disposed in front casing 7 and rear casing 9, respectively, so as to reduce a clearance between the inner circumferential surfaces of bearings 59, 61 and the outer circumferential surface of drive shaft 49. With this construction, centering of drive shaft 49 can be attained to thereby enhance an assembling efficiency of pump apparatus 1.

[Effects]

Pump apparatus 1 according to the first embodiment can attain the following effects.

(1) Pump apparatus 1 includes: drive shaft 49 supported by drive-side needle bearing 59 and drive-side ball bearing 61 (i.e., drive-side bearing members) on both end portions of drive shaft 49; driven shaft 52 supported by first driven-side needle bearing 60 and second driven-side needle bearing 62 (i.e., driven-side bearing members) on both end portions of driven shaft 52; first external gears 109 including first drive gear 50 which is driven by drive shaft 49 and first driven gear 53 which is meshed with first drive gear 50 and supported on driven shaft 52; center plate 8 formed with drive shaft through-hole 22 (i.e., first through-hole) through which drive shaft 49 extends and driven shaft through-hole 23 (i.e., second through-hole) through which driven shaft 52 extends; second external gears 110 which are opposed to first external gears 109 so as to sandwich center plate 8 between first external gears 109 and second external gears 110, second external gears 110 including second drive gear 51 which is driven by drive shaft 49 and second driven gear 54 which is meshed with second drive gear 51 and supported on driven shaft 52; side plate portion 96 (i.e., first side plate) of first seal block 57 which is disposed to sandwich first external gears 109 between side plate portion 96 of first seal block 57 and center plate 8; side plate portion 96 (i.e., second side plate) of second seal block 58 which is disposed to sandwich second external gears 110 between side plate portion 96 of second seal block 58 and center plate 8; seal block portion 97 (i.e., first seal member) of first seal block 57 which includes seal surfaces 94, 95 sealing tooth tips of first external gears 109 and defines first pump chamber 135 in cooperation with center plate 8; seal block portion 97 (i.e., second seal member) of second seal block 58 which includes seal surfaces 94, 95 sealing tooth tips of second external gears 110 and defines second pump chamber 136 in cooperation with center plate 8; and shaft seal members 63, 64 (i.e., pressing mechanism) which apply a pressing force between tooth tips of respective gears 50, 51, 53, 54 and seal surfaces 94, 95 of respective seal block portions 97 in a closing region disposed between respective gears 50, 51, 53, 54 and respective seal block portions 97 such that the tooth tips of respective gears 50, 51, 53, 54 and seal surfaces 94, 95 are allowed to press against each other in the closing region, wherein the contact between an inner circumferential surface of respective bearings 59, 61 and an outer circumferential surface of drive shaft 49 and the contact between an inner circumferential surface of respective bearings 60, 62 and an outer circumferential surface of driven shaft 52 are established on the side of the closing region, while the tooth tips of respective gears 50, 51, 53, 54 and seal surfaces 94, 95 of respective seal block portions 97 in the closing region are kept pressed against each other by shaft seal members 63, 64.

Accordingly, even when parts have relatively low dimensional accuracy, it is possible to ensure the contact between the tooth tips of respective gears 50, 51, 53, 54 and seal surfaces 94, 95 of seal block portions 97 and the contact between the inner circumferential surface of respective bearings 59, 61 and the outer circumferential surface of drive shaft 49 and between the inner circumferential surface of respective bearings 60, 62 and the outer circumferential surface of driven shaft 52. As a result, pump apparatus 1 can be enhanced in assemblability and suppress displacement of drive shaft 49, driven shaft 52 and gears 50, 51, 53, 54 to thereby increase pumping efficiency.

(2) Assuming that the closing region is in a first quadrant of a unit circle in a coordinate plane which has a center aligned with a central axis of drive shaft through-hole 22 (or a central axis of shaft seal accommodating hole 29), the side of the closing region in which the contact between the inner circumferential surface of respective bearings 59, 61 and the outer circumferential surface of drive shaft 49 is established and the side of the closing region in which the contact between the inner circumferential surface of respective bearings 60, 62 and the outer circumferential surface of driven shaft 52 is established are located in the first quadrant and/or a second quadrant of the unit circle.

Therefore, by contacting the inner circumferential surface of respective bearings 59, 61 and the outer circumferential surface of drive shaft 49 and contacting the inner circumferential surface of respective bearings 60, 62 and the outer circumferential surface of driven shaft 52 in the first quadrant and/or a second quadrant of the unit circle, it is possible to establish the contact between the tooth tips of gears 50, 51, 53, 54 and seal surfaces 94, 95 of seal block portion 97 of respective seal blocks 57, 58 in the closing region, and at the same time, establish the contact between the inner circumferential surface of respective bearings 59, 61 and the outer circumferential surface of drive shaft 49 and the contact between the inner circumferential surface of respective bearings 60, 62 and the outer circumferential surface of driven shaft 52 on the side of the closing region.

(3) Shaft seal members 63, 64 are used as a pressing mechanism for pressing drive shaft 49 and driven shaft 52. Shaft seal members 63, 64 are disposed between an inner circumferential surface of shaft seal accommodating hole 29 of center plate 8 and an outer circumferential surface of drive shaft 49, and between an inner circumferential surface of shaft seal accommodating hole 30 of center plate 8 and an outer circumferential surface of driven shaft 52, respectively. Shaft seal members 63, 64 serve for blocking fluid communication between first pump chamber 135 and second pump chamber 136.

Shaft seal members 63, 64 have both a pressing function and a sealing function, and therefore, the number of parts can be reduced.

(4) Pump apparatus 1 further includes front casing 7 (i.e., housing) having bearing mounting holes 15, 46 into which bearings 59, 60 are mounted, respectively, and rear casing 9 (i.e., housing) having bearing mounting holes 42, 39 into which bearings 61, 62 are mounted, respectively. Pump apparatus 1 further includes pressing pins 66, 67, 68 and pressure reducing seal member 79 (i.e., clearance reducing mechanism) by which the contact between the inner circumferential surface of respective bearings 59, 61 and the outer circumferential surface of drive shaft 49 and the contact between the inner circumferential surface of respective bearings 60, 62 and the outer circumferential surface of driven shaft 52 are established on the side of the closing region. Pressing pin 66 is disposed between bearing mounting hole 15 and drive shaft 49, and pressing pin 67 is disposed between bearing mounting hole 46 and driven shaft 52. Pressure reducing seal member 79 is disposed between bearing mounting hole 42 and drive shaft 49, and pressing pin 68 is disposed between bearing mounting hole 39 and driven shaft 52.

With the provision of pressing pins 66, 67, 68 and pressure reducing seal member 79, the inner circumferential surface of respective bearings 59, 61 and the outer circumferential surface of drive shaft 49 can be contacted with each other, and the inner circumferential surface of respective bearings 60, 62 and the outer circumferential surface of driven shaft 52 can be contacted with each other.

Accordingly, it is possible to establish the contact between the inner circumferential surface of respective bearings 59, 61 and the outer circumferential surface of drive shaft 49 and the contact between the inner circumferential surface of respective bearings 60, 62 and the outer circumferential surface of driven shaft 52 by using pressing pins 66, 67, 68 and pressure reducing seal member 79 which have a simple structure.

(5) Seal block portion 97 and side plate portion 96 of first seal block 57 are integrally formed with each other and held in place relative to center plate 8 in such a state that tooth tips of first external gears 109 are kept in contact with seal surfaces 94, 95 of seal block portion 97 of first seal block 57.

As a result, the number of parts can be reduced. Further, it is possible to provide a center plate assembly in which first seal block 57 is fixed to center plate 8 and therefore, enhance an assemblability.

(6) Seal block portion 97 and side plate portion 96 of second seal block 58 are integrally formed with each other and held in place relative to center plate 8 in such a state that tooth tips of second external gears 110 are kept in contact with seal surfaces 94, 95 of seal block portion 97 of second seal block 58.

As a result, the number of parts can be reduced. Further, it is possible to provide a center plate assembly in which second seal block 58 is fixed to center plate 8 and therefore, enhance an assemblability.

(7) First seal block 57 and second seal block 58 are each in the form of a resin-molded product.

Therefore, it is possible to facilitate formation of first seal block 57 and second seal block 58 even though they have a complicated configuration.

(8) Shaft seal members 63, 64 include holder members 114 (i.e., sleeve-shaped resin members) having inner circumferential surfaces which are slidably contacted with drive shaft 49 and driven shaft 52, respectively, and seal rings 99 (i.e., annular elastic members) fitted into seal grooves 80 (i.e., annular grooves) which are formed on outer circumferential surfaces of holder members 114, respectively. Seal rings 99 allow drive shaft 49 and driven shaft 52 to be eccentric with respect to drive shaft through-hole 22 and driven shaft through-hole 23 of center plate 8, thereby biasing drive gears 50, 51 and driven gears 53, 54 in a radial direction thereof so as to reduce a clearance between the tooth tips of drive gears 50, 51 and seal surfaces 94 of seal block portions 97 and a clearance between the tooth tips of driven gears 53, 54 and seal surfaces 95 of seal block portions 97.

With the provision of seal rings 99, shaft seal members 63, 64 can perform not only a sealing function but also a pressing function, thereby serving for reducing the number of parts.

(9) Pressing pin 66 and pressure reducing seal member 79 are arranged closer to opposite axial ends of drive shaft 49 than bearings 59, 61 in the axial direction of drive shaft 49, and pressing pins 67, 68 are arranged closer to opposite axial ends of driven shaft 52 than bearings 60, 62 in the axial direction of driven shaft 52.

With this arrangement, it is possible to ensure a sufficient distance between shaft seal members 63, 64 and pressing pins 66, 67, 68 and pressure reducing seal member 79. Therefore, the pressing force of pressing pins 66, 67, 68 and pressure reducing seal member 79 has a less influence on the pressing direction of shaft seal members 63, 64. As a result, it is possible to keep reduction in the clearance between the tooth tips of drive gears 50, 51 and seal surfaces 94 of seal block portions 97 and the clearance between the tooth tips of driven gears 53, 54 and seal surfaces 95 of seal block portions 97.

(10) First drive gear 50 and second drive gear 51 are biased in the same radial direction thereof. Therefore, both first drive gear 50 and second drive gear 51 can be biased by pressing single drive shaft 49.

(11) Pump apparatus 1 includes front casing 7 having bearing mounting holes 15, 46 into which bearings 59, 60 are mounted, respectively, and rear casing 9 having bearing mounting holes 42, 39 into which bearings 61, 62 are mounted, respectively. Further, pressing pins 66, 67 are disposed between bearing mounting hole 15 and drive shaft 49 and between bearing mounting hole 46 and driven shaft 52, respectively. Pressing pin 68 is disposed between bearing mounting hole 39 and driven shaft 52, and pressure reducing seal member 79 is disposed between bearing mounting hole 42 and drive shaft 49.

With this arrangement, when front casing 7 and rear casing 9 are assembled to center plate 8, centering of drive shaft 49 and driven shaft 52 is automatically performed only by pressing pins 66, 67, 68 and pressure reducing seal member 79 to thereby establish the contact between the inner circumferential surface of respective bearings 59, 61 and the outer circumferential surface of drive shaft 49 and the contact between the inner circumferential surface of respective bearings 60, 62 and the outer circumferential surface of driven shaft 52.

(13) Pump apparatus 1 is a pump apparatus for use in a vehicular brake apparatus which pressurizes fluid pressure in a plurality of wheel cylinders by pumping action of first pump chamber 135 and second pump chamber 136. With this construction, two pump chambers can be provided using single pump apparatus 1 without using two individual pump apparatuses, thereby serving for downsizing the brake apparatus as a whole.

(14) Pump apparatus 1 includes: drive shaft 49 rotatably supported by bearings 59, 61; drive gears 50, 51 which are driven by drive shaft 49; side plate portions 96 of seal blocks 57, 58 and side plates 55, 56 which are disposed adjacent to opposite side surfaces of respective drive gears 50, 51 in an axial direction of drive gears 50, 51; seal block portions 97 of seal blocks 57, 58 each having drive-side seal surface 94 which seals tooth tips of respective drive gears 50, 51 and cooperates with side plate portions 96 and side plates 55, 56 to form each of pump chambers 135, 136; shaft seal members 63, 64 (i.e., pressing mechanism) which bias drive gears 50, 51 in a radial direction thereof to allow the tooth tips of respective drive gears 50, 51 and drive-side seal surface 94 of respective seal block portions 97 to press against each other in a closing region disposed between drive gears 50, 51 and seal block portions 97; and pressing pin 66 and pressure reducing seal member 79 (i.e., clearance reducing mechanism) disposed between drive shaft 49 and casings 7, 9 (i.e., housing) to which bearings 59, 61 are mounted, the pressing pin 66 and the pressure reducing seal member 79 allowing an inner circumferential surface of respective bearings 59, 61 and an outer circumferential surface of drive shaft 49 to be contacted with each other on the side of the closing region, while the tooth tips of respective drive gears 50, 51 are kept pressed against drive-side seal surface 94 of respective seal block portions 97 in the closing region by shaft seal members 63, 64.

With this construction, even in a case where parts have relatively low dimensional accuracy, it is possible to ensure the contact between the tooth tips of respective drive gears 50, 51 and drive-side seal surfaces 94 of seal block portions 97 and the contact between the inner circumferential surface of respective bearings 59, 61 and the outer circumferential surface of drive shaft 49. Accordingly, pump apparatus 1 can be enhanced in assemblability, and displacement of drive shaft 49 and drive gears 50, 51 can be suppressed to thereby increase a pump efficiency.

(15) Assuming that the closing region is located in a first quadrant of a unit circle in a coordinate plane which has a center aligned with a central axis of drive shaft through-hole 22 (or, a central axis of shaft seal accommodating hole 29) of center plate 8, the side of the closing region in which the contact between the inner circumferential surface of respective bearings 59, 61 and the outer circumferential surface of drive shaft 49 is established is located in the first quadrant and/or a second quadrant of the unit circle.

Therefore, by contacting the inner circumferential surface of respective bearings 59, 61 and the outer circumferential surface of drive shaft 49 in the first quadrant and/or the second quadrant, it is possible to establish the contact between the tooth tips of gears 50, 51 and seal surfaces 94 of seal block portions 97 in the closing region, and at the same time, establish the contact between the inner circumferential surface of respective bearings 59, 61 and the outer circumferential surface of drive shaft 49.

(16) Shaft seal member 63 is constructed to bias drive shaft 49 toward the closing region. Further, shaft seal member 63 is disposed between the outer circumferential surface of drive shaft 49 and an inner circumferential surface of shaft seal accommodating hole 29 which is formed in center plate 8.

With this construction, it is possible to ensure the contact between the tooth tips of drive gears 50, 51 and drive-side seal surfaces 94 of seal blocks 97.

(17) Bearings 59, 61 support opposite axial end portions of drive shaft 49, respectively. Further, pressing pin 66 and pressure reducing seal member 79 are disposed closer to opposite axial ends of drive shaft 49 than bearings 59, 61.

With this arrangement, it is possible to ensure a sufficient distance between shaft seal member 63, and pressing pin 66 and pressure reducing seal member 79. Therefore, the pressing force of pressing pin 66 and pressure reducing seal member 79 has a less influence on the pressing direction of shaft seal member 63. As a result, it is possible to keep reduction in the clearance between the tooth tips of drive gears 50, 51 and seal surfaces 94 of seal block portions 97 of seal blocks 57, 58.

(18) Seal block portion 97 (i.e., seal member) and side plate portion 96 (i.e., one of side plates) of respective seal blocks 57, 58 are integrally formed of a resin material, and held in place relative to side plates 55, 56 (i.e., the other of side plates) in such a state that the tooth tips of respective drive gears 50, 51 are in contact with drive-side seal surface 94 of respective seal block portions 97.

With this construction, the number of parts can be reduced. Further, it is possible to provide a center plate assembly in which seal blocks 57, 58 are held in place relative to side plates 55, 56, and therefore, enhance an assemblability.

(19) Pump apparatus 1 is assembled by the method including a drive shaft assembling step, a pump sub-assembling step and a pump assembling step. In the drive shaft assembling step, drive shaft 49 which is to be driven by a motor (i.e., a driving source) is assembled to center plate 8 such that a central axis of drive shaft 49 is allowed to be eccentric with respect to drive shaft through-hole 22 of center plate 8 so as to project tooth tips of respective drive gears 50, 51 mounted to drive shaft 49 beyond seal surface 94 of respective seal blocks 57, 58 to be subsequently assembled in the pump sub-assembling step and seal the tooth tips of respective drive gears 50, 51. In the pump sub-assembling step after completing the drive shaft assembling step, seal blocks 57, 58 are assembled to center plate 8 to carry out positioning thereof relative to center plate 8 such that an amount of the projection of the tooth tips of respective drive gears 50, 51 beyond seal surface 94 is reduced. In the pump assembling step after completing the pump sub-assembling step, drive shaft 49 assembled to center plate 8 is assembled to front casing 7 and rear casing 9 so as to support drive shaft 49 on front casing 7 and rear casing 9 while carrying out centering of drive shaft 49.

By the method of assembling pump apparatus 1, seal blocks 57, 58 can be fixed to center plate 8 while keeping seal surfaces 94 of seal blocks 57, 58 in contact with drive gears 50, 51. As a result, pump apparatus 1 can be enhanced in assemblability.

(20) The pump assembling step is carried out using bearings 59, 61 which are disposed in front casing 7 and rear casing 9, respectively, and pressing pin 66 and pressure reducing seal member 79 which are disposed in front casing 7 and rear casing 9, respectively, so as to reduce a clearance between the inner circumferential surface of respective bearings 59, 61 and the outer circumferential surface of drive shaft 49. With this construction, centering of drive shaft 49 can be accomplished to thereby enhance an assembling efficiency of pump apparatus 1.

Figure 22:
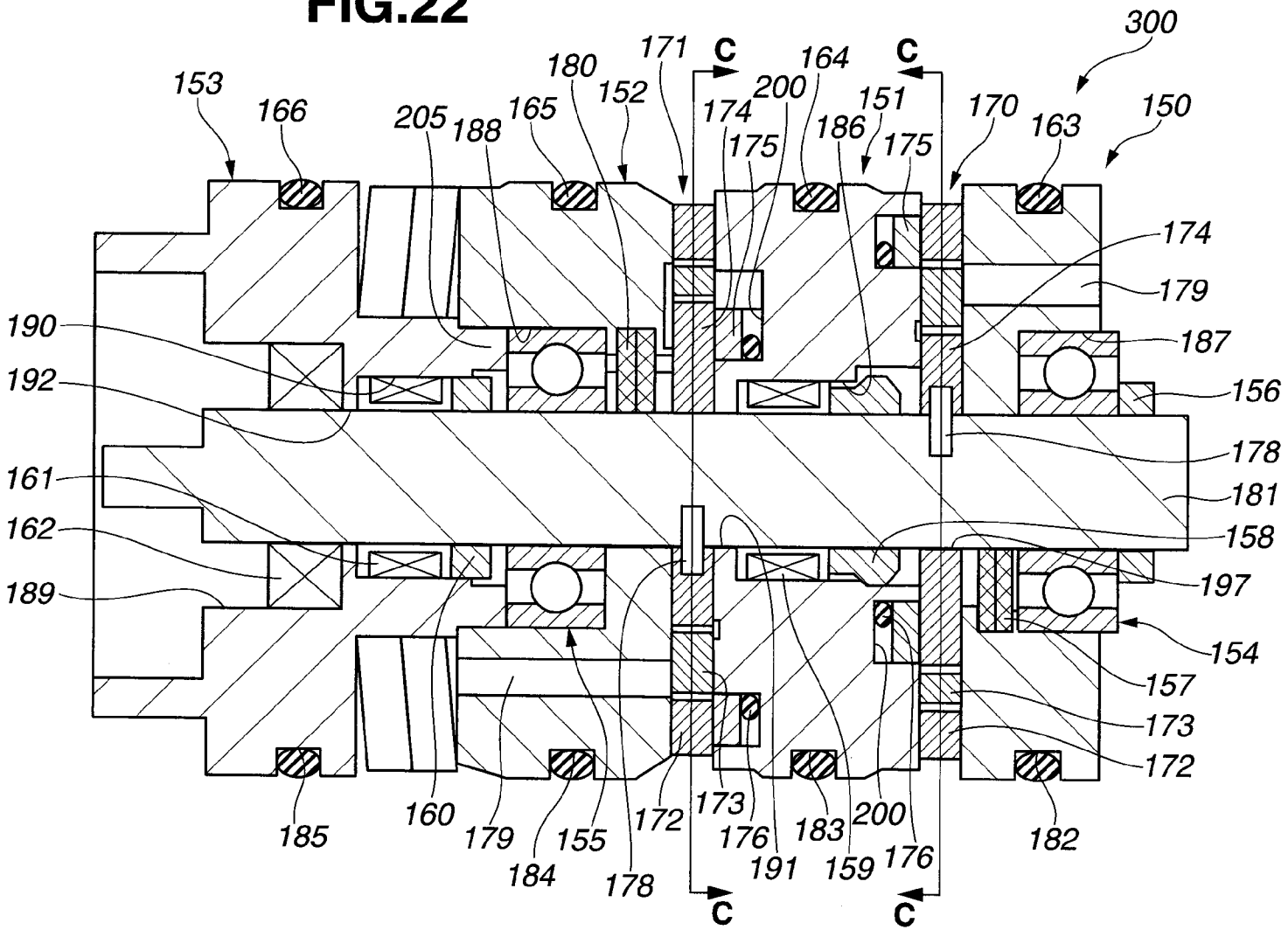
FIG. 22 is a cross section of the pump apparatus according to a second embodiment of the present invention, taken in an axial direction thereof.
Figure 23:
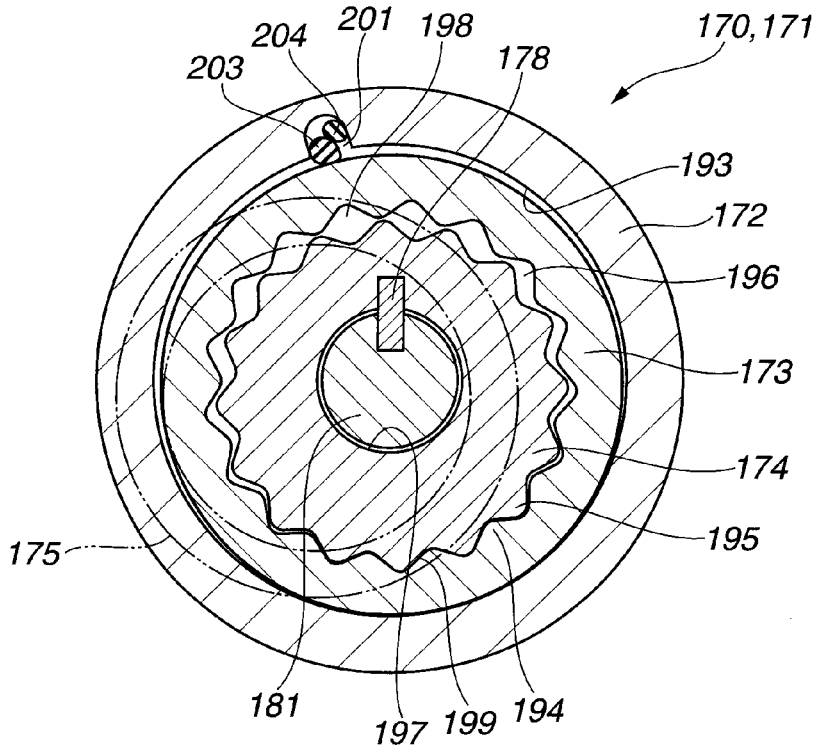
FIG. 23 is a cross section of the pump apparatus according to the second embodiment of the present invention, taken in a radial direction thereof.
Figure 24:
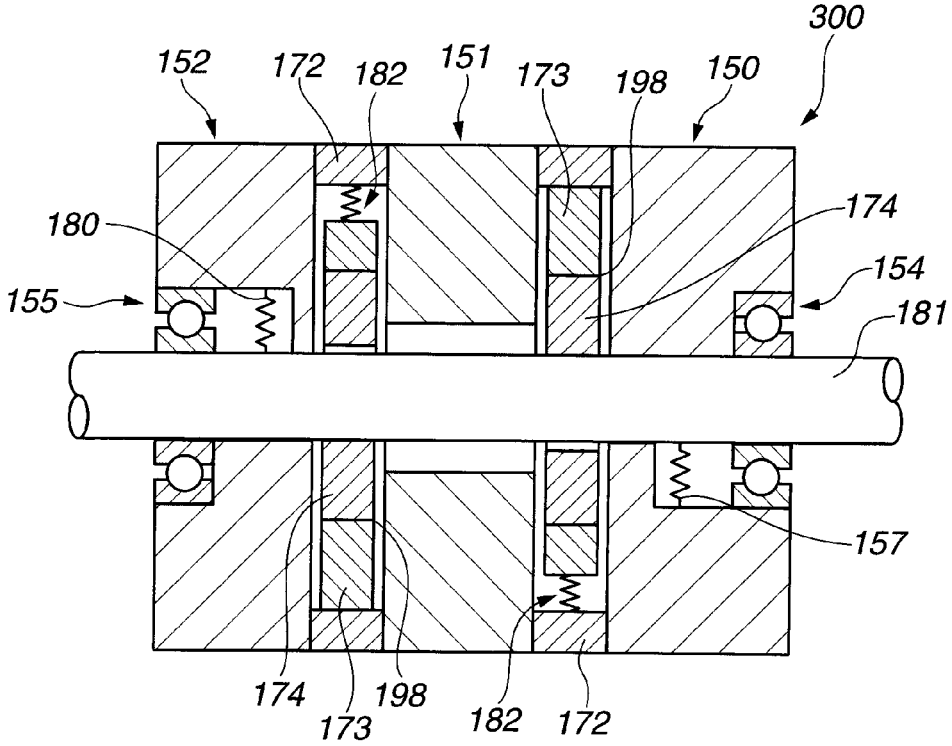
FIG. 24 is a schematic diagram showing the pump apparatus according to the second embodiment of the present invention.

Referring to FIG. 22 to FIG. 24, a pump apparatus according to a second embodiment of the present invention will be explained hereinafter. The second embodiment differs from the first embodiment in that internal gears are used instead of the external gears of the first embodiment.

[Construction]

FIG. 22 is a cross section of a pump apparatus according to the second embodiment, taken in an axial direction thereof. FIG. 23 is a cross section of the pump apparatus according to the second embodiment, taken along line C-C as shown in FIG. 22. The pump apparatus according to the second embodiment is a tandem trochoid pump. Meanwhile, FIG. 23 is a cross section of a first pump mechanism and a second pump mechanism of the pump apparatus according to the second embodiment as explained later. The first pump mechanism and the second pump mechanism have same construction.

As shown in FIG. 22, pump apparatus 300 according to the second embodiment is a tandem internal gear pump which includes first casing 150, center plate 151, second casing 152, third casing 153, first pump mechanism 170 disposed between first casing 150 and center plate 151, and second pump mechanism 171 disposed between center plate 151 and second casing 152.

First casing 150 has seal groove 182 on an outer circumference surface thereof. Seal groove 182 has a generally U-shaped section and extends over an entire circumference of first casing 150. Seal ring 163 is fitted into seal groove 182. Center plate 151 has seal groove 183 having a generally U-shaped section on an outer circumference surface thereof. Seal groove 183 has a generally U-shaped section and extends over an entire circumference of center plate 151. Seal ring 164 is fitted into seal groove 183. Second casing 152 has seal groove 184 on an outer circumference surface thereof. Seal groove 184 has a generally U-shaped section and extends over an entire circumference of second casing 152. Seal ring 165 is fitted into seal groove 184. Third casing 153 has seal groove 185 on an outer circumference surface thereof. Seal groove 185 has a generally U-shaped section and extends over an entire circumference of third casing 153. Seal ring 166 is fitted into seal groove 185.

Drive shaft 181 extends through first casing 150, center plate 151, second casing 152 and third casing 153. Drive shaft 181 is rotatably supported by first ball bearing 154 mounted to first casing 150 and second ball bearing 155 mounted to second casing 152.

First ball bearing 154 is disposed in bearing accommodating portion 187 formed in first casing 150. First ball bearing 154 is held in place by bearing accommodating portion 187 and stop 156 press-fitted onto drive shaft 181. Second ball bearing 155 is disposed in bearing accommodating portion 188 formed in second casing 152. Second ball bearing 155 is held in place by bearing accommodating portion 188 and fitting end portion 205 of third casing 153 which is fitted into bearing accommodating portion 188.

Eccentric member 157 is disposed on drive shaft 181 between first ball bearing 154 and first pump mechanism 170 in an axial direction of drive shaft 181. Eccentric member 180 is disposed on drive shaft 181 between second ball bearing 155 and second pump mechanism 171 in an axial direction of drive shaft 181.

Center plate 151 includes seal member accommodating portion 186 opened to one axial end surface of center plate 151 on the side of first casing 150. Through-hole 191 is disposed adjacent to seal member accommodating portion 186 and opened to the other axial end surface of center plate 151 on the side of second casing 152. Drive shaft 181 extends through through-hole 191. Seal member 159 is disposed in seal member accommodating portion 186 on the side of through-hole 191. Seal restraining member 158 is disposed in seal member accommodating portion 186 on an opposite side of through-hole 191, that is, on the side of an opening of seal member accommodating portion 186. Seal restraining member 158 restrains a displacement of seal member 159 in an axial direction of center plate 151.

Third casing 153 includes seal member accommodating portion 190 disposed on the side of second casing 152. Seal member accommodating portion 190 is formed on a radial inside of fitting portion 205 and opened to an axial end surface of fitting portion 205. Seal member 161 and seal restraining member 160 are disposed in seal member accommodating portion 190. Seal restraining member 160 is disposed on the side of an open end of fitting portion 205, and seal member 161 is disposed on an opposite side of the open end of fitting portion 205. Seal restraining member 160 restrains a displacement of seal member 160 in an axial direction of third casing 153.

Third casing 153 includes seal member accommodating portion 189 disposed on an opposite side of seal member accommodating portion 190 in the axial direction of third casing 153. Seal member 162 is disposed in seal member accommodating portion 189. Through-hole 192 is disposed between seal member accommodating portion 190 and seal member accommodating portion 189, and seal member accommodating portion 190 and seal member accommodating portion 189 is communicated with each other through through-hole 192. Drive shaft 181 extends through through-hole 192. Seal member accommodating portion 189 has an open end to which a motor as a driving source is connected. Drive shaft 181 is connected with an output shaft of the motor and rotatably driven by the motor. Seal member 161 and seal member 162 cooperate with each other to form a dual sealing structure and thereby prevent working oil from leaking from pump apparatus 300 into the side of the motor.

[Construction of Pump Mechanism]

As shown in FIG. 23, respective first and second pump mechanisms 170 and 171 include outer casing 172, outer rotor 173 disposed on a radial inside of outer casing 172, and inner rotor 174 disposed on a radial inside of outer rotor 173.

Outer rotor 173 and inner rotor 174 are accommodated in rotor chamber 193 formed in outer casing 172. Outer rotor 173 and inner rotor 174 are held in an assembled state in which central axes of outer rotor 173 and inner rotor 174 are eccentric with each other. Outer rotor 173 has internal gear 194 on an inner circumferential surface thereof. Inner rotor 174 has external gear 195 on an outer circumferential surface thereof. Internal gear 194 and external gear 195 are engaged with each other through only one meshing portion. Internal gear 194 and external gear 195 cooperate with each other to form a plurality of pump chambers 196 therebetween.

Inner rotor 174 has through-hole 197 in a central portion thereof through which drive shaft 181 extends. Inner rotor 174 is fixed to drive shaft 181 by gear retaining pin 178 so as to make a unitary rotation with drive shaft 181.

Among the plurality of pump chambers 196, the pump chamber having a maximum volume is hereinafter referred to as closing region 198, and the pump chamber having a minimum volume is hereinafter referred to as meshing portion 199. As shown in FIG. 22, center plate 151 has grooves 200 on opposed axial end surfaces thereof into each of which side seal member 175 and pressing member 176 are inserted. Pressing members 176 are disposed behind side seal members 175 and press the corresponding side seal members 175 toward the side of first pump mechanism 170 and the side of second pump mechanism 171, respectively. As shown in FIG. 23, side seal members 175 are arranged to overlap with closing region 198 and meshing portion 199.

As shown in FIG. 23, outer casing 172 has pressing member accommodating hole 201 on an inner circumferential surface thereof into which pressing member 203 is mounted. Biasing member 204 are disposed behind pressing member 203 in pressing member accommodating hole 201. Pressing member 203 is in contact with outer rotor 173 and urged to press outer rotor 173 toward closing portion 198 by biasing member 204.

[Function of Pressing Shaft by Eccentric Member and Pressing Member]

FIG. 24 is a schematic diagram showing pump apparatus 300 according to the second embodiment of the present invention. Pressing member 203 applies a pressing force between outer rotor 173 and inner rotor 174 such that outer rotor 173 and inner rotor 174 are pressed against each other in closing portion 198. Eccentric members 157, 180 disposed between ball bearings 154, 155 in the axial direction of drive shaft 181 allow inner circumferential surface of respective ball bearings 154, 155 and an outer circumferential surface of drive shaft 181 to be contacted with each other on the side of closing portion 198.

[Function]

Pump apparatus 300 includes pressing member 203 which presses outer rotor 173 in a radial direction of outer rotor 173 and applies a pressing force between external teeth 195 of inner rotor 174 and internal teeth 194 of outer rotor 173 such that external teeth 195 and internal teeth 194 are pressed against each other in closing portion 198 disposed between inner rotor 174 and outer rotor 173. Pump apparatus 300 further includes eccentric member 157 disposed between drive shaft 181 and casing 150 into which ball bearing 154 is mounted, and eccentric member 180 disposed between drive shaft 181 and casing 152 into which ball bearing 155 is mounted. Eccentric members 157, 180 (i.e., clearance reducing mechanism) allow the inner circumferential surface of respective ball bearings 154, 155 and the outer circumferential surface of drive shaft 181 to be contacted with each other on the side of closing portion 198 while external teeth 195 and internal teeth 194 are kept pressed against each other by pressing member 203.

With this construction, even in a case where parts have relatively low dimensional accuracy, it is possible to ensure the contact between external teeth 195 of inner rotor 174 and internal teeth 194 of outer rotor 173 and the contact between the inner circumferential surface of respective ball bearings 154, 155 and the outer circumferential surface of drive shaft 181. Accordingly, pump apparatus 300 can be enhanced in assemblability, and displacement of drive shaft 181 and inner rotor 174 can be suppressed to thereby increase a pump efficiency.

[Effect]

Pump apparatus 300 according to the second embodiment can attain the following effect.

(21) Pump apparatus 300 includes: drive shaft 181 rotatably supported by ball bearings 154, 155; inner rotor 174 (i.e., drive gear) which is driven by drive shaft 181; center plate 151 disposed adjacent to one side of inner rotor 174 in an axial direction of inner rotor 174, and casings 150, 152 disposed adjacent to the other side of inner rotor 174 in the axial direction of inner rotor 174; outer rotor 173 (i.e., seal member) having internal gear 194 (i.e., seal surface) which seals tooth tips of external gear 195 of inner rotor 174, outer rotor 173 forming pump chamber 196 in cooperation with center plate 151 and casings 150, 152; pressing member 203 which biases outer rotor 173 in a radial direction of outer rotor 173 to press internal gear 194 of outer rotor 173 against external gear 195 of inner rotor 174 in closing portion 198 disposed between inner rotor 174 and outer rotor 173; and eccentric members 157, 180 (i.e., clearance reducing mechanism) disposed between drive shaft 181 and casings 150, 152 to which ball bearings are mounted, eccentric members 157, 180 allowing the inner circumferential surface of respective ball bearings 154, 155 and the outer circumferential surface of drive shaft 181 to be contacted with each other on the side of closing portion 198 while internal gear 194 of outer rotor 173 is kept pressed against external gear 195 of inner rotor 174 in closing portion 198 by pressing member 203.

With this construction, even in a case where parts have relatively low dimensional accuracy, it is possible to ensure the contact between external teeth 195 of inner rotor 174 and internal teeth 194 of outer rotor 173 and the contact between the inner circumferential surfaces of ball bearings 154, 155 and the outer circumferential surface of drive shaft 181. Accordingly, pump apparatus 300 can be enhanced in assemblability, and displacement of drive shaft 181 and inner rotor 174 can be suppressed to thereby increase a pump efficiency.

Other Embodiments

The present invention is not limited to the above-described first and second embodiments and may be modified without departing from the scope of the invention.

Although the pump apparatus according to the first and second embodiments is the tandem pump having two pumps, the pump apparatus having a single pump can be used.

Furthermore, other technical concepts and effects of the present invention which are understandable from the above embodiments are described as follows.

In a sixth aspect of the present invention, there is provided the pump apparatus according to the fifth aspect, wherein the second seal member and the second side plate are integrally formed with each other and held in place relative to the center plate in such a state that the tooth tips of the second external gears are kept in contact with the seal surfaces of the second seal member.

With this construction, the number of parts can be reduced. Further, it is possible to provide the center plate assembly in which the first seal member is fixed to the center plate and thereby enhance an assemblability.

In a seventh aspect of the present invention, there is provided the pump apparatus according to the sixth aspect, wherein the first seal member and the first side plate which are integrally formed and the second seal member and the second side plate which are integrally formed are each in the form of a resin-molded product.

With this construction, it is possible to facilitate forming the respective seal members and the respective side plates which have a complicated shape.

In an eighth aspect of the present invention, there is provided the pump apparatus according to the third aspect, wherein the respective shaft seal members include a sleeve-shaped resin member and an annular elastic member fitted into an annular groove which is formed on an outer circumferential surface of the sleeve-shaped resin member, the shaft seal members having inner circumferential surfaces which are slidably contacted with the drive shaft and the driven shaft, respectively, the annular elastic member allowing the drive shaft and the driven shaft to be eccentric with respect to through-holes of the center plate through which the drive shaft and the driven shaft extend, respectively, to thereby bias the first and second drive gears and the first and second driven gears in a radial direction thereof so as to reduce a clearance between the tooth tips of the first and second external gears and the seal surfaces of the first and second seal members.

With the provision of the elastic annular member, the shaft seal member can perform not only a sealing function but also a pressing function, thereby serving for reducing the number of parts.

In a ninth aspect of the present invention, there is provided the pump apparatus according to the fourth aspect, wherein the clearance reducing means are arranged closer to opposite axial ends of the drive shaft than the drive-side bearing members in an axial direction of the drive shaft, and arranged closer to opposite axial ends of the driven shaft than the driven-side bearing members in an axial direction of the driven shaft, and the respective shaft seal members include a sleeve-shaped resin member and an annular elastic member fitted into an annular groove which is formed on an outer circumferential surface of the sleeve-shaped resin member, the shaft seal members having inner circumferential surfaces which are slidably contacted with the drive shaft and the driven shaft, respectively, the annular elastic member allowing the drive shaft and the driven shaft to be eccentric with respect to through-holes of the center plate through which the drive shaft and the driven shaft extend, respectively, to thereby bias the first and second drive gears and the first and second driven gears in a radial direction thereof so as to reduce a clearance between the tooth tips of the first and second external gears and the seal surfaces of the first and second seal members.

With this construction, it is possible to ensure a sufficient distance between the pressing member and the clearance reducing means and thereby reduce an influence of the pressing force of the clearance reducing means on the pressing direction of the pressing member. Therefore, the reduced clearance between the respective gears and the seal surfaces can be maintained.

In a tenth aspect of the present invention, there is provided the pump apparatus according to the fourth aspect, wherein the first drive gear and the second drive gear are biased in same radial direction thereof.

With this construction, both the drive shaft and the driven shaft can be biased by biasing only the drive shaft.

In an eleventh aspect of the present invention, there is provided the pump apparatus according to the first aspect, further including:

a housing having drive-side bearing mounting holes into which the drive-side bearing members are mounted, respectively, and driven-side bearing mounting holes into which the driven-side bearing members are mounted, respectively; and a clearance reducing means for establishing the contact between the inner circumferential surface of the respective drive-side bearing members and the outer circumferential surface of the drive shaft and the contact between the inner circumferential surface of the respective driven-side bearing members and the outer circumferential surface of the driven shaft on the side of the closing region, the clearance reducing means being disposed between the respective drive-side bearing mounting holes and the drive shaft and between the respective driven-side bearing mounting holes and the driven shaft.

With this construction, upon assembling the housing to the center plate, centering of the drive shaft and the driven shaft can be automatically performed by the clearance reducing means to thereby establish the contact between the inner circumferential surfaces of the bearing members and the outer circumferential surface of the drive shaft and the contact between the inner circumferential surfaces of the bearing members and the outer circumferential surface of the driven shaft.

In a twelfth aspect of the present invention, there is provided the pump apparatus according to the eleventh aspect, wherein the clearance reducing means are arranged closer to opposite axial ends of the drive shaft than the drive-side bearing members in an axial direction of the drive shaft, and arranged closer to opposite axial ends of the driven shaft than the driven-side bearing members in an axial direction of the driven shaft.

With this construction, it is possible to ensure a sufficient distance between the pressing member and the clearance reducing mechanism and thereby reduce an influence of the pressing force of the clearance reducing mechanism on the pressing direction of the pressing member. Therefore, the reduced clearance between the respective gears and the seal surfaces can be maintained.

In a thirteenth aspect of the present invention, there is provided the pump apparatus according to the first aspect, wherein the pump apparatus is a pump apparatus for use in a vehicular brake apparatus which pressurizes fluid pressure in a plurality of wheel cylinders by pumping action of the first pump chamber and the second pump chamber.

With this construction, two pump chambers can be provided using single pump apparatus 1 without using two pump apparatuses, thereby serving for downsizing the brake apparatus as a whole.

In a fourteenth aspect of the present invention, there is provided a pump apparatus including:

a drive shaft rotatably supported by bearing members;

a drive gear which is driven by the drive shaft;

side plates disposed adjacent to opposite side surfaces of the drive gear in an axial direction of the drive gear;

a seal member having a seal surface which seals tooth tips of the drive gear and cooperate with the side plates to form a pump chamber; and a pressing means for biasing the drive gear or the seal member in a radial direction thereof to allow the tooth tips of the drive gear and the seal surface of the seal member to press against each other in a closing region disposed between the drive gear and the seal member, wherein contact between an inner circumferential surface of the respective bearing members and an outer circumferential surface of the drive shaft is established on the side of the closing region, while the tooth tips of the drive gear and the seal surface of the seal member are kept pressed against each other in the closing region by the pressing means.

With this construction, even in a case where parts have relatively low dimensional accuracy, it is possible to ensure the contact between the tooth tips of the respective drive gears and the seal surface of the respective seal members and the contact between the inner circumferential surface of the respective bearing members and the outer circumferential surface of the drive shaft. Accordingly, the assemblability of the pump apparatus can be enhanced, and displacement of the drive shaft and the drive gear can be suppressed to thereby increase a pump efficiency.

In a fifteenth aspect of the present invention, there is provided the pump apparatus according to the fourteenth aspect, further including a center plate formed with a pressing means accommodating hole in which the pressing means is disposed, wherein assuming that the closing region disposed between the drive gear and the seal member is located in a first quadrant of a unit circle in a coordinate plane which has a center aligned with a central axis of the pressing means accommodating hole, the side of the closing region in which the contact between the inner circumferential surface of the respective bearing members and the outer circumferential surface of the drive shaft is established is located in the first quadrant and/or a second quadrant of the unit circle.

Accordingly, by contacting the inner circumferential surface of the respective bearing members and the outer circumferential surface of the drive shaft with each other in the first quadrant and/or the second quadrant of the coordinate plane, it is possible to establish the contact between the inner circumferential surface of the respective bearing members and the outer circumferential surface of the drive shaft while keeping the contact between the tooth tips of the respective drive gears and the seal surface of the respective seal members in the closing region.

In a sixteenth aspect of the present invention, there is provided the pump apparatus according to the fifteenth aspect, wherein the pressing means is a biasing member which biases the drive shaft toward the closing region, the biasing member being disposed between the outer circumferential surface of the drive shaft and an inner circumferential surface of the pressing means accommodating hole.

With this construction, it is possible to ensure the contact between the tooth tips of the drive gear and the seal surface.

In a seventeenth aspect of the present invention, there is provided the pump apparatus according to the sixteenth aspect, wherein the bearing members support opposite axial end portions of the drive shaft, respectively, the pump apparatus further including a housing to which the bearing members are mounted, and a clearance reducing means for establishing the contact between the inner circumferential surface of the respective bearing members and the outer circumferential surface of the drive shaft on the side of the closing region, the clearance reducing means being disposed between the drive shaft and the housing and being located closer to opposite axial ends of the drive shaft than the bearing members.

With this construction, it is possible to ensure a sufficient distance between the pressing member and the clearance reducing means and thereby reduce an influence of the pressing force of the clearance reducing means on the pressing direction of the pressing member. Therefore, the reduced clearance between the respective gears and the seal surfaces can be maintained.

In an eighteenth aspect of the present invention, there is provided the pump apparatus according to the seventeenth aspect, wherein the seal member and one of the side plates are integrally formed of a resin material, and held in place relative to the other of the side plates in such a state that the tooth tips of the drive gear are in contact with the seal surface of the seal member.

With this construction, the number of parts can be reduced. Further, it is possible to provide the center plate assembly in which the seal member is held in place relative to the side plate, and therefore, enhance an assemblability of the pump apparatus.

In a nineteenth aspect of the present invention, there is provided a method of assembling a pump apparatus which includes a housing, a drive shaft to be driven by a driving source, gears mounted to the drive shaft, seal members which seal tooth tips of the respective gears, and a center plate having a through-hole, the method including:

a drive shaft assembling step of assembling the drive shaft to the center plate such that a central axis of the drive shaft is allowed to be eccentric with respect to the through-hole of the center plate so as to project the tooth tips of the respective gears mounted to the drive shaft beyond a seal surface of the respective seal members to be subsequently assembled;

a pump sub-assembling step of assembling the seal members to the center plate to carry out positioning of the respective seal members relative to the center plate such that an amount of the projection of the tooth tips of the respective gears beyond the seal surface is reduced; and a pump assembling step of assembling the drive shaft assembled to the center plate to the housing so as to support the drive shaft in the housing while carrying out centering of the drive shaft.

By the method according to the nineteenth aspect, the seal members can be fixed to the center plate in the state in which the seal surface of the respective seal members and the tooth tips of the respective gears mounted to the drive shaft are contacted with each other. As a result, it is possible to enhance an assemblability of the pump apparatus.

In a twentieth aspect of the present invention, there is provided the method according to the nineteenth aspect, wherein the pump assembling step is carried out using bearing members which are disposed in the housing, and a clearance reducing means which are disposed in the housing so as to reduce a clearance between an inner circumferential surface of the respective bearing members and an outer circumferential surface of the drive shaft.

By the method according to the twentieth aspect, centering of the drive shaft relative to the housing can be automatically performed to thereby enhance the assemblability.

This application is based on a prior Japanese Patent Application No. 2010-191010 filed on Aug. 27, 2010. The entire contents of the Japanese Patent Application No. 2010-191010 is hereby incorporated by reference.

Although the invention has been described above by reference to certain embodiments of the invention, the invention is not limited to the embodiments described above. Modifications and variations of the embodiments described above will occur to those skilled in the art in light of the above teachings. The scope of the invention is defined with reference to the following claims.

What is claimed is:

1. A pump apparatus comprising:

a drive shaft supported by drive-side bearing members on both end portions of the drive shaft;

a driven shaft supported by driven-side bearing members on both end portions of the driven shaft;

first external gears comprising a first drive gear which is driven by the drive shaft and a first driven gear which is meshed with the first drive gear and supported on the driven shaft;

a center plate formed with a first through-hole through which the drive shaft extends and a second through-hole through which the driven shaft extends;

second external gears which are opposed to the first external gears so as to sandwich the center plate between the first and second external gears, the second external gears comprising a second drive gear which is driven by the drive shaft and a second driven gear which is meshed with the second drive gear and supported on the driven shaft;

a first seal block having a first side plate portion and a first seal block portion, the first side plate portion being disposed so as to sandwich the first external gears between the first side plate portion and the center plate, the first seal block portion comprising seal surfaces sealing tooth tips of the first external gears, the first seal block portion defining a first pump chamber in cooperation with the center plate;

a second seal block having a second side plate portion and a second seal block portion, the second side plate portion being disposed so as to sandwich the second external gears between the second side plate portion and the center plate, the second seal block portion comprising seal surfaces sealing tooth tips of the second external gears, the second seal block portion defining a second pump chamber in cooperation with the center plate; and a pressing means for applying a pressing force between the tooth tips of the respective first and second external gears and the seal surfaces of the respective first and second seal block portions in a closing region disposed between the respective first and second external gears and the respective first and second seal block portions such that the tooth tips of the respective first and second external gears and the seal surfaces of the respective first and second seal block portions are allowed to press against each other in the closing region, wherein contact between an inner circumferential surface of the respective drive-side bearing members and an outer circumferential surface of the drive shaft and contact between an inner circumferential surface of the respective driven-side bearing members and an outer circumferential surface of the driven shaft are established on the side of the closing region, while the tooth tips of the respective first and second external gears and the seal surfaces of the respective first and second seal block portions in the closing region are kept pressed against each other by the pressing means.

2. The pump apparatus as claimed in claim 1, wherein assuming that the closing region disposed between the first and second external gears and the first and second seal block portions is located in a first quadrant of a unit circle in a coordinate plane which has a center aligned with a central axis of the first through-hole of the center plate, the side of the closing region in which the contact between the inner circumferential surface of the respective drive-side bearing members and the outer circumferential surface of the drive shaft is established and the side of the closing region in which the contact between the inner circumferential surface of the respective driven-side bearing members and the outer circumferential surface of the driven shaft is established are located in the first quadrant and/or a second quadrant of the unit circle.

3. The pump apparatus as claimed in claim 2, wherein the center plate is formed with a first pressing means accommodating hole and a second pressing means accommodating hole, and the pressing means are shaft seal members which are disposed between an inner circumferential surface of the first pressing means accommodating hole and the outer circumferential surface of the drive shaft and between an inner circumferential surface of the second pressing means accommodating hole and the outer circumferential surface of the driven shaft, respectively, the shaft seal members serving for blocking fluid communication between the first pump chamber and the second pump chamber.

4. The pump apparatus as claimed in claim 3, further comprising:

a housing having drive-side bearing mounting holes into which the drive-side bearing members are mounted, respectively, and driven-side bearing mounting holes into which the driven-side bearing members are mounted, respectively; and a clearance reducing means for establishing the contact between the inner circumferential surface of the respective drive-side bearing members and the outer circumferential surface of the drive shaft and the contact between the inner circumferential surface of the respective driven-side bearing members and the outer circumferential surface of the driven shaft on the side of the closing region, the clearance reducing means being disposed between the respective drive-side bearing mounting holes and the drive shaft and between the respective driven-side bearing mounting holes and the driven shaft.

5. The pump apparatus as claimed in claim 4, wherein the first seal block portion and the first side plate portion are integrally formed with each other and held in place relative to the center plate in such a state that the tooth tips of the first external gears are kept in contact with the seal surfaces of the first seal block portion.

6. The pump apparatus as claimed in claim 5, wherein the second seal block portion and the second side plate portion are integrally formed with each other and held in place relative to the center plate in such a state that the tooth tips of the second external gears are kept in contact with the seal surfaces of the second seal block portion.

7. The pump apparatus as claimed in claim 6, wherein the first block portion and the first side plate portion which are integrally formed and the second seal block portion and the second side plate portion which are integrally formed are each in the form of a resin-molded product.

8. The pump apparatus as claimed in claim 7, wherein the respective shaft seal members comprise a sleeve-shaped resin member and an annular elastic member fitted into an annular groove which is formed on an outer circumferential surface of the sleeve-shaped resin member, the shaft seal members having inner circumferential surfaces which are slidably contacted with the drive shaft and the driven shaft, respectively, the respective annular elastic members allowing the drive shaft and the driven shaft to be eccentric with respect to the first and second through-holes of the center plate to thereby bias the first and second drive gears and the first and second driven gears in a radial direction thereof so as to reduce a clearance between the tooth tips of the first and second external gears and the seal surfaces of the first and second seal block portions.

9. The pump apparatus as claimed in claim 4, wherein the clearance reducing means are arranged closer to opposite axial ends of the drive shaft than the drive-side bearing members in an axial direction of the drive shaft, and arranged closer to opposite axial ends of the driven shaft than the driven-side bearing members in an axial direction of the driven shaft, and the respective shaft seal members comprise a sleeve-shaped resin member and an annular elastic member fitted into an annular groove which is formed on an outer circumferential surface of the sleeve-shaped resin member, the shaft seal members having inner circumferential surfaces which are slidably contacted with the drive shaft and the driven shaft, respectively, the respective annular elastic members allowing the drive shaft and the driven shaft to be eccentric with respect to the first and second through-holes of the center plate to thereby bias the first and second drive gears and the first and second driven gears in a radial direction thereof so as to reduce a clearance between the tooth tips of the first and second external gears and the seal surfaces of the first and second seal block portions.

10. The pump apparatus as claimed in claim 4, wherein the first drive gear and the second drive gear are biased in same radial direction thereof.

11. The pump apparatus as claimed in claim 1, further comprising:

a housing having drive-side bearing mounting holes into which the drive-side bearing members are mounted, respectively, and driven-side bearing mounting holes into which the driven-side bearing members are mounted, respectively; and a clearance reducing means for establishing the contact between the inner circumferential surface of the respective drive-side bearing members and the outer circumferential surface of the drive shaft and the contact between the inner circumferential surface of the respective driven-side bearing members and the outer circumferential surface of the driven shaft on the side of the closing region, the clearance reducing means being disposed between the respective drive-side bearing mounting holes and the drive shaft and between the respective driven-side bearing mounting holes and the driven shaft.

12. The pump apparatus as claimed in claim 11, wherein the clearance reducing means are arranged closer to opposite axial ends of the drive shaft than the drive-side bearing members in an axial direction of the drive shaft, and arranged closer to opposite axial ends of the driven shaft than the driven-side bearing members in an axial direction of the driven shaft.

13. The pump apparatus as claimed in claim 11, wherein the pump apparatus is a pump apparatus for use in a vehicular brake apparatus which pressurizes fluid pressure in a plurality of wheel cylinders by pumping action of the first pump chamber and the second pump chamber.

14. A pump apparatus comprising:

a drive shaft rotatably supported by bearing members;

a drive gear which is driven by the drive shaft;

a seal block having a side plate portion and a seal block portion;

a side plate, the side plate portion of the seal block and the side plate disposed adjacent to opposite side surfaces of the drive gear in an axial direction of the drive gear, the seal block portion having a seal surface which seals tooth tips of the drive gear and cooperates with the side plate portion of the seal block and the side plate to form a pump chamber; and a pressing means for biasing the drive gear or the seal block in a radial direction thereof to allow the tooth tips of the drive gear and the seal surface of the seal block portion to press against each other in a closing region disposed between the drive gear and the seal block portion, wherein contact between an inner circumferential surface of the respective bearing members and an outer circumferential surface of the drive shaft is established on the side of the closing region, while the tooth tips of the drive gear and the seal surface of the seal block portion are kept pressed against each other in the closing region by the pressing means.

15. The pump apparatus as claimed in claim 14, further comprising a center plate formed with a through-hole through which the drive shaft extends, wherein assuming that the closing region disposed between the drive gear and the seal block portion is located in a first quadrant of a unit circle in a coordinate plane which has a center aligned with a central axis of the through-hole of the center plate, the side of the closing region in which the contact between the inner circumferential surface of the respective bearing members and the outer circumferential surface of the drive shaft is established is located in the first quadrant and/or a second quadrant of the unit circle.

16. The pump apparatus as claimed in claim 15, wherein the pressing means is a biasing member which biases the drive shaft toward the closing region, the biasing member being disposed between the outer circumferential surface of the drive shaft and an inner circumferential surface of a pressing means accommodating hole formed in the center plate.

17. The pump apparatus as claimed in claim 16, wherein the bearing members support opposite axial end portions of the drive shaft, respectively, the pump apparatus further comprising a housing to which the bearing members are mounted, and a clearance reducing means for establishing the contact between the inner circumferential surface of the respective bearing members and the outer circumferential surface of the drive shaft on the side of the closing region, the clearance reducing means being disposed between the drive shaft and the housing and being located closer to opposite axial ends of the drive shaft than the bearing members.

18. The pump apparatus as claimed in claim 17, wherein the seal block portion and the side plate portion are integrally formed of a resin material, and held in place relative to the side plate in such a state that the tooth tips of the drive gear are in contact with the seal surface of the seal block portion.

* * * * *